US011402081B1

(12) United States Patent
Hargroder et al.

(10) Patent No.: US 11,402,081 B1
(45) Date of Patent: Aug. 2, 2022

(54) ADJUSTABLE LIGHTING DEVICE

(71) Applicant: Troy-CSL Lighting Inc., City of Industry, CA (US)

(72) Inventors: Ty Hargroder, Los Angeles, CA (US); Kenneth Moore, Arcadia, CA (US); Jacob Hawkins, Sierra Madre, CA (US)

(73) Assignee: Troy-CSL Lighting Inc., City of Industry, CA (US)

( * ) Notice: Subject to any disclaimer, the term of this patent is extended or adjusted under 35 U.S.C. 154(b) by 0 days.

(21) Appl. No.: 17/353,622

(22) Filed: Jun. 21, 2021

(51) Int. Cl.
*F21V 17/02* (2006.01)
*F21V 14/02* (2006.01)
*F21V 29/70* (2015.01)

(52) U.S. Cl.
CPC ..... *F21V 17/02* (2013.01); *F21V 14/02* (2013.01); *F21V 29/70* (2015.01)

(58) Field of Classification Search
CPC ... F21S 8/00; F21S 8/028; F21S 8/026; F21V 14/02; F21V 29/70; F21V 17/02
See application file for complete search history.

(56) References Cited

U.S. PATENT DOCUMENTS

| | | | | |
|---|---|---|---|---|
| 10,145,519 | B1 | 12/2018 | Portinga | |
| 10,760,782 | B2 | 9/2020 | Portinga et al. | |
| 10,837,610 | B2 | 11/2020 | Portinga | |
| 10,955,112 | B2 | 3/2021 | Portinga | |
| 2015/0308662 | A1* | 10/2015 | Vice | F21V 21/30 362/419 |
| 2017/0184285 | A1* | 6/2017 | Visser | F21V 21/047 |
| 2017/0284617 | A1* | 10/2017 | Coakley | F21V 29/503 |
| 2020/0348001 | A1* | 11/2020 | Spicer | F21V 21/04 |

FOREIGN PATENT DOCUMENTS

| | | | | |
|---|---|---|---|---|
| GB | 2519430 | A * | 4/2015 | F21S 8/026 |

* cited by examiner

*Primary Examiner* — Anabel Ton
(74) *Attorney, Agent, or Firm* — Foley & Lardner LLP

(57) ABSTRACT

A lighting device assembly includes a light source attached to a heat sink member to emit light in a first direction. A support structure supports the heat sink member in a pivotally adjustable orientation about an adjustment axis, to allow adjustment of the first direction. A drive mechanism selectively drives the heat sink member to pivotally adjust the orientation of the heat sink member about the adjustment axis to change the first direction. The drive mechanism includes a drive screw having, a collar threaded to the drive screw to move linearly along the drive screw axis as the drive screw is rotated, and at least one strut to transfer linear movement of the collar to pivotal movement of the heat sink member.

20 Claims, 28 Drawing Sheets

ADJUSTABLE LIGHTING DEVICE

CROSS-REFERENCE TO RELATED PATENT APPLICATIONS

This application is related to U.S. application Ser. No. 15/984,008 (now U.S. Pat. No. 10,145,519), filed on May 18, 2018, which is a continuation of U.S. application Ser. No. 15/828,243 (now U.S. Pat. No. 10,837,610), filed on Nov. 30, 2017, each of which is incorporated herein by reference in its entirety. This application is also related to U.S. application Ser. No. 16/175,470 (now U.S. Pat. No. 10,955,112), filed on Oct. 30, 2018, and U.S. application Ser. No. 16/226,526 (now U.S. Pat. No. 10,760,782), filed on Dec. 19, 2018, each of which is incorporated herein by reference in its entirety.

BACKGROUND

Modern lighting devices have electronic light sources for emitting light, such as one or more light emitting diode (LED) components. Typically, the brightness of an LED light source is at least partially related to the speed in which heat can be transferred away from the LED component. For example, it may be desirable to maintain the temperature of the LED under about 105° Celsius for improved or maximum light output and efficiency. However, certain lighting devices such as, but not limited to, room or area lighting devices, may be configured to be mounted in an enclosed environment, such as in a housing and/or in a recess of a ceiling, wall or other structure. In those or other contexts, the lighting device may be mounted in a thermally contained or poorly ventilated environment which can inhibit the ability to quickly transfer heat away from the LED. Accordingly, it can be desirable to provide lighting device configurations that allow for sufficient transfer of heat from the LED light source to maintain the temperature of the light source at or below a threshold temperature during operation and, particularly, during operation in a thermally contained or poorly ventilated environment.

In addition, in certain contexts it may be desirable to provide lighting device configurations that allow for adjustment of the direction of light emission from the light source. Such adjustable lighting device configurations can provide advantages including the ability to adjust the direction of light emission into certain areas or onto certain objects in a room or other environment. However, if the LED component is mounted on a moveable structure to adjust a light beam direction, there may be significant challenges to efficiently transfer heat from the LED component through moveable components of the moveable structure, to maintain the temperature of the light source at or below the threshold temperature.

Accordingly, lighting device assemblies of various examples described herein can be configured to have good heat transfer characteristics (to transfer and dissipate heat away from the LED), while also allowing the light emission direction of the lighting device assembly to be selectable or adjustable. Those and further examples relate to adjustment mechanisms for lighting device assemblies that allow for efficient and smooth adjustment of the direction of the pattern or path of light emission.

In certain examples, the lighting device assembly to be located within a housing and/or within a recess or opening in a ceiling, wall or other object. In other examples described herein, the lighting device assembly may be surface mounted on a surface of a ceiling, wall or other object, or mounted on a pedestal or other support structure extending from a ceiling, wall, or other object. In yet other examples described herein, the lighting assembly may be mounted in other suitable locations or environments.

SUMMARY

An example lighting device assembly includes a heat sink member, a light source attached to the heat sink member in a position to emit light in a first direction and a support structure for supporting the heat sink member in a pivotally adjustable orientation about the first adjustment axis, to allow adjustment of the first direction. The lighting device assembly further includes a drive mechanism for selectively driving the heat sink member to pivotally adjust the orientation of the heat sink member about the first adjustment axis to change the first direction. The drive mechanism includes a threaded drive screw having a lengthwise drive screw axis and supported for rotation about the drive screw axis, with the drive screw axis being fixed relative to the first adjustment axis. The drive mechanism further includes a collar threaded to the drive screw to move linearly along the drive screw axis as the drive screw is rotated about the drive screw axis relative to the collar, and at least one strut pivotally coupled to the collar and further pivotally coupled to the heat sink member, to transfer linear movement of the collar along the drive screw axis to pivotal movement of the heat sink member about the first adjustment axis, to change the angle of the first direction.

Further examples also include a first pivotal joint having a first joint axis connecting the at least one strut to the collar, and a second pivotal joint having a second pivotal axis connecting the at least one strut to the heat sink member, where the first joint axis is parallel to the second joint axis.

In further examples, the first joint axis and the second joint axis are parallel to the first adjustment axis.

In further examples, the support structure includes a support plate supported in a rotatably adjustable orientation about a second adjustment axis, to allow adjustment of the first direction about the second adjustment axis that is transverse to the first adjustment axis.

In further examples, the second adjustment axis is perpendicular to the first adjustment axis.

In further examples, the support structure further includes a mounting housing configured to be secured in or to a ceiling, wall or other object, and a guide rail provided on the mounting housing, the guide rail supporting the support plate for rotational movement about the second adjustment axis.

In further examples, the support structure further includes a rotary mount on the support plate for supporting the drive screw for rotation about the lengthwise drive screw axis relative to the rotary mount, and to retain the drive screw from movement in a linear direction of the drive screw axis relative to the rotary mount as the drive screw is rotated about the drive screw axis relative to the rotary mount.

In further examples, the drive screw includes a first section having threads, a second section devoid of threads and a shoulder located between the first section and the second section, the second section is located within a channel in the rotary mount, and the first section and the shoulder are located outside of the rotary mount.

In further examples, a mounting housing configured to be secured in or to a ceiling, wall or other object, where the support plate is supported on the mounting housing for rotation about the second adjustment axis relative to the mounting housing. In addition, the mounting housing has an open side that is exposed when the mounting housing is secured in a ceiling, wall or other object. In addition, an end portion of the drive screw extends through the support plate and is accessible through the open side of the mounting housing, to allow rotation of the drive screw.

In further examples, the support structure includes at least one flange extending from a first end portion of the heat sink member and connected to a pivot joint for pivotal movement of the heat sink member about the first adjustment axis.

Further examples also include a mounting housing configured to be secured in or to a ceiling, wall or other object. In such examples, the support structure is secured to the mounting housing. In addition, the mounting housing has an open side that is exposed when the mounting housing is secured in a ceiling, wall or other object. In addition, a tilt indicator is provided on the mounting housing in a location that is viewable through the exposed open side of the mounting housing. The tilt indicator has a surface that is overlapped by a portion of the at least one flange, where an amount of overlap of the surface by the at least one flange is dependent upon and changes with the pivotal movement of the heat sink member about the first adjustment axis.

In further examples, the support structure includes a support plate supported in a rotatably adjustable orientation about a second adjustment axis transverse to the first adjustment axis. In addition, at least one flange extends from a first end portion of the heat sink member and is connected to a pivot joint for pivotal movement of the heat sink member about the first adjustment axis. In addition, at least one further flange extends from the support plate and is arranged in thermal contact with the at least one flange extending from the first end portion of the heat sink member to transfer heat between the contacting flanges.

In further examples, one of the at least one flange and the at least one further flange has a projection and the other of the at least one flange and the at least one further flange has a curved slot in which the projection is received and slides during pivotal movement of the heat sink member about the first adjustment axis.

In further examples, one of the at least one flange comprises two flanges that extend from the first end portion of the heat sink, and the at least one further flange comprises two flanges that extend from the support plate and that are in thermal contact with the two flanges that extend from the first end portion of the heat sink.

In further examples, the heat sink member has at least one slot in which the at least one strut is at least partially received during some or all of the pivotal movement of the heat sink member about the first adjustment axis.

In further examples, the at least one strut comprises a first strut on one side of the collar and a second strut on a second side of the collar, and wherein the collar is located between the first strut and the second strut.

In further examples, the support structure is configured to support the heat sink member for pivotally adjustable movement about the first adjustment axis to adjust an angle of the first direction relative to a reference axis.

In further examples, the first direction corresponds to an axis of a cone or pattern of light emitted by the light source, when the light source is energized.

In further examples, the lighting device assembly is in a system of a plurality of lighting device assemblies each having as discussed above, where the system further includes a first mounting housing configured to be secured in or to a ceiling, wall or other object, the first mounting housing configured for being selectively connected to the supporting the support plate of the lighting device assembly. In addition, the system includes a second mounting housing configured to be secured in or to a ceiling, wall or other object, the second mounting housing configured for being selectively connected to the supporting the support plate of the lighting device assembly, the second mounting housing having a different shape than the first mounting housing. The support plate of the lighting device assembly may be selectively coupled to either one of the first mounting housing and the second mounting housing, one at a time, to allow the lighting device assembly to fit into different shaped openings depending upon to which mounting housing of the first and the second mounting housings the support plate is selectively coupled.

A method of making a lighting device assembly according to an example includes providing a heat sink member, attaching a light source to the heat sink member in a position to emit light in a first direction, and supporting the heat sink member with a support structure, in a pivotally adjustable orientation about the first adjustment axis, to allow adjustment of the first direction. The method further includes coupling a drive mechanism to selectively pivotally adjust the orientation of the heat sink member about the first adjustment axis to change the first direction. Coupling the drive mechanism includes supporting a threaded drive screw for rotation about a lengthwise drive screw axis, with the drive screw axis being fixed relative to the first adjustment axis, threading a collar to the drive screw to allow the collar to move linearly along the drive screw axis as the drive screw is rotated about the drive screw axis relative to the collar, and pivotally coupling at least one strut to the collar and further pivotally coupling the at least one strut to the heat sink member, to transfer linear movement of the collar along the drive screw axis to pivotal movement of the heat sink member about the first adjustment axis, to change the angle of the first direction.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1:
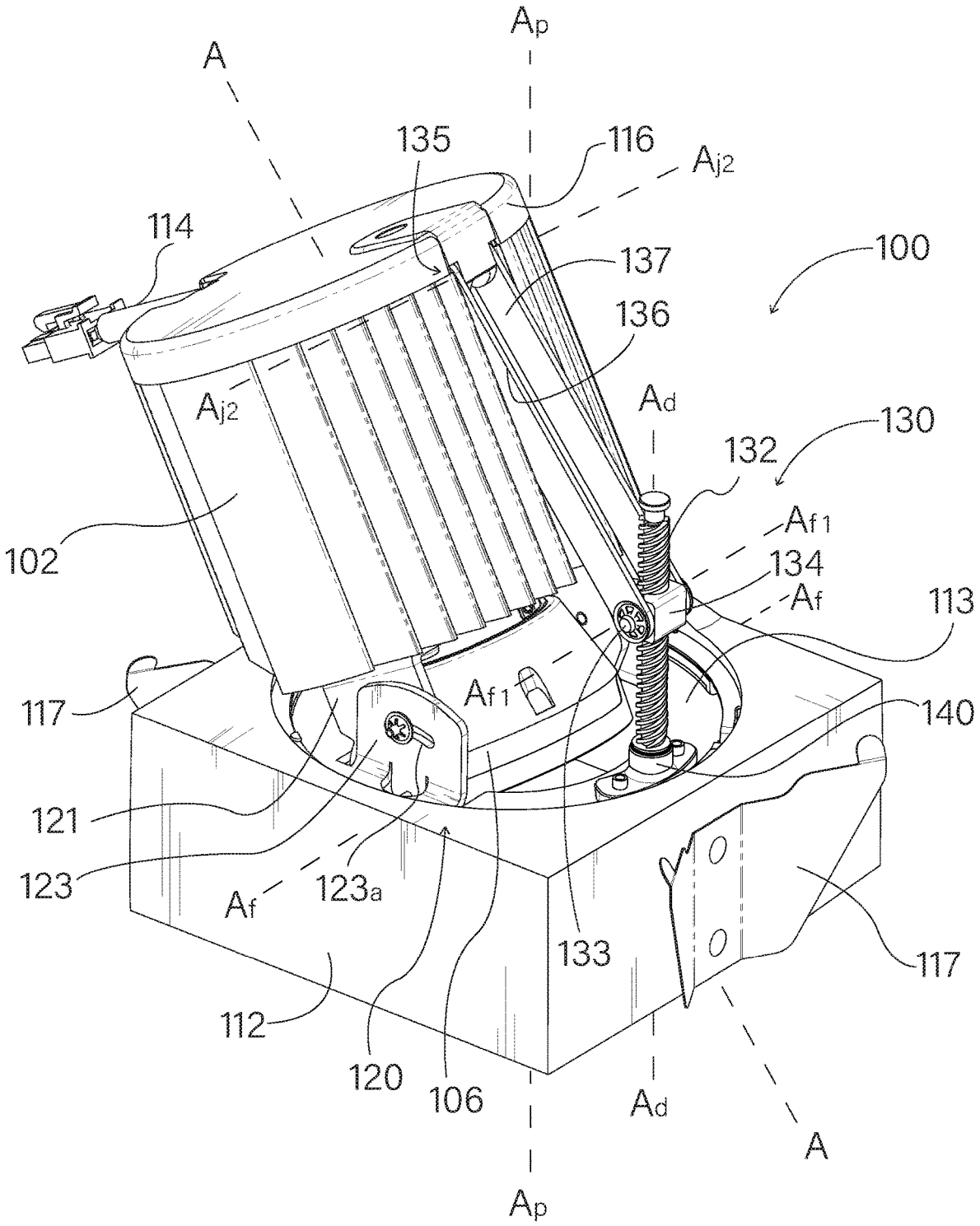
FIG. 1 is a perspective view of an example lighting device assembly.

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," "coupled to," "secured to" or "attached to" another element or feature, it can be directly on, connected to, coupled to, secured to or attached to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various examples described herein, a lighting device assembly is configured to be installed in a recess or opening provided in a ceiling, wall, outer housing or other object. In some examples, the lighting device assembly is configured to be installed in an opening to a plenum, duct or attic space of a ceiling, or in an inner wall space in a manner to appear flush or substantially flush with an exposed surface of a ceiling, wall or other object. In other examples, variations of the lighting device assembly may be configured to be installed in a manner that is not flush with an exposed surface (and, instead, is configured to be recessed or protruding from the exposed surface of a ceiling, wall, outer housing or other object), or is configured to be surface-mounted on the exposed surface of the ceiling, wall, outer housing or other object. In yet other examples, variations of the lighting device assembly may be configured to be mounted on a support structure (such as, but not limited to a sconce structure, pedestal, shaft or the like).

The lighting device assembly includes a light source and an optic member that are configured to emit light in a cone or other pattern having a general axis or light emission direction. In examples in which the optic member includes one or more lenses, the axis of the light emission may correspond to an optical axis of the one or more lenses. In other examples, the axis of the light emission may correspond to a center of the light cone or pattern emitted by the light source and optic.

When mounted in a ceiling, wall, outer housing or other object, or on a support structure, the lighting device assembly may be selectively adjusted, to change, select or adjust the light emission direction (or the direction of the axis of the optic member or the axis of the light cone or other pattern emitted from the optic member). In certain examples, an angle or direction of light emitted from a light source of the lighting device assembly is selectively adjustable about a first adjustment axis. In certain examples, the rotational orientation of the light source (and the radial direction of the light emitted from the light source) is selectively adjustable a second adjustment axis transverse (e.g., perpendicular) to the first adjustment axis. In particular examples, the angle or direction of light emitted from the light source may be selectively adjusted about both the first adjustment axis and the second adjustment axis, to provide a wide range (or a defined range) of selectable light emission directions.

In addition to providing direction adjustment functions, particular examples are configured to also provide sufficient thermal communication and heat dissipation characteristics to help maintain the temperature of the light source at or below a desired threshold temperature for improved operation. Accordingly, particular embodiments provide enhanced thermal coupling in components that also provide direction adjustment capabilities, such that the heat transfer and dissipation characteristics of the lighting device assembly need not be sacrificed for direction adjustment capabilities.

Figure 2:
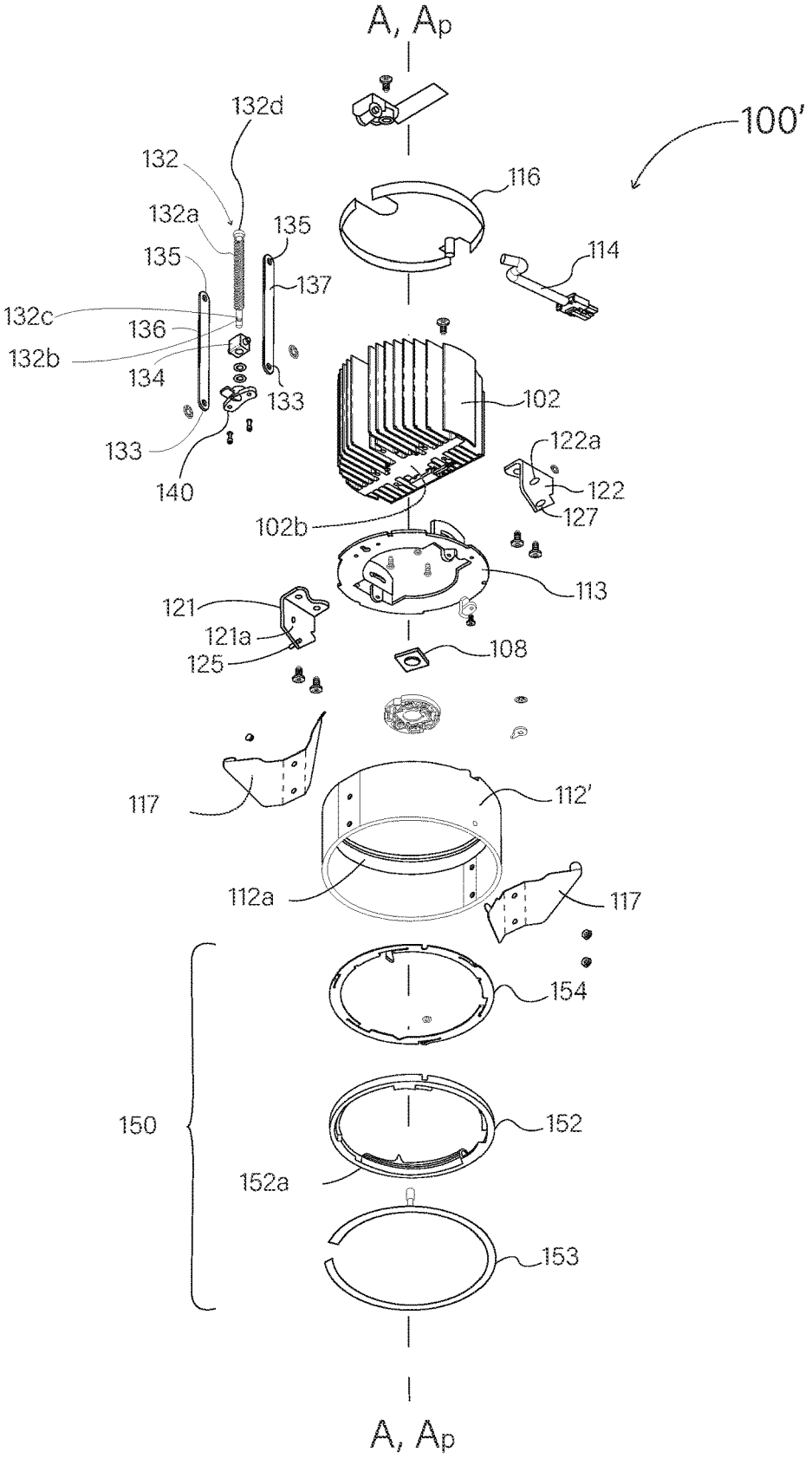
FIG. 2 is a partial exploded, perspective view (bottom-side perspective) of the lighting device assembly in FIG. 1, but with a cylindrical mounting housing.
Figure 3:
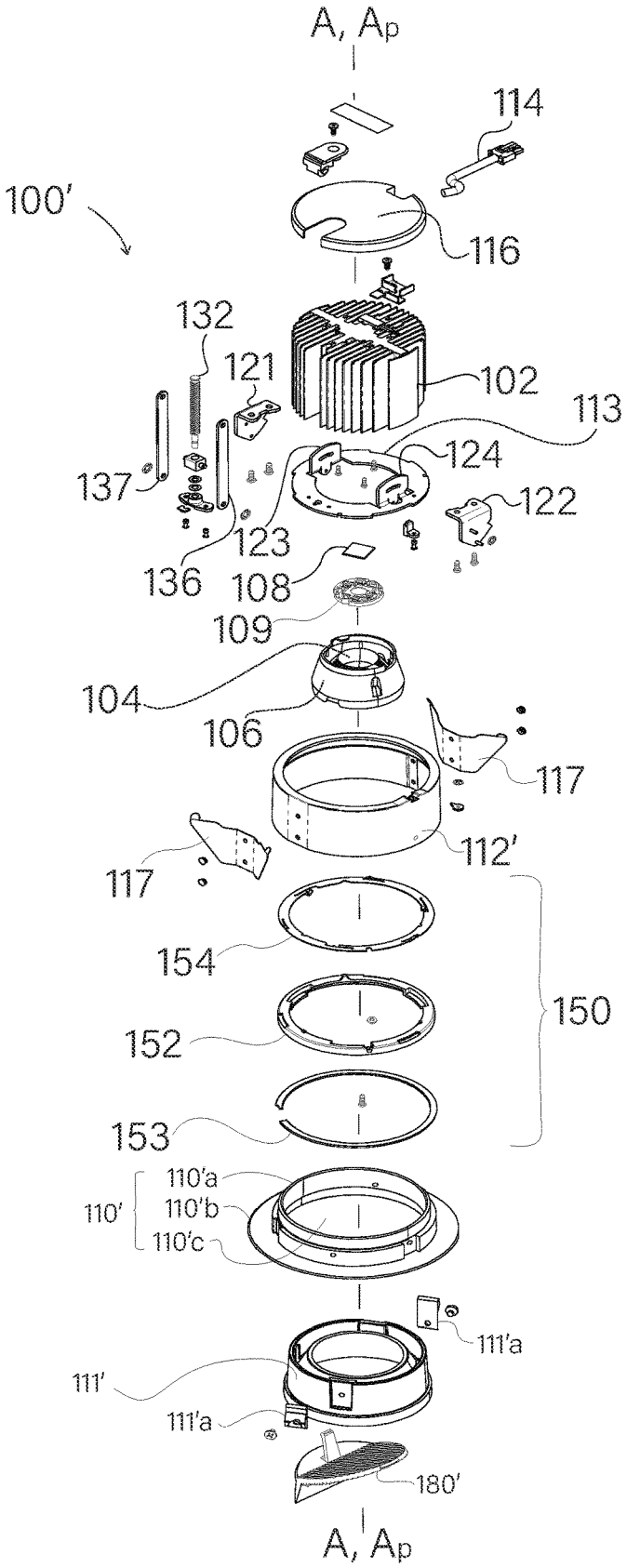
FIG. 3 is another partial exploded perspective view of the lighting device assembly of FIG. 2, but from a top-side perspective.
Figure 4:
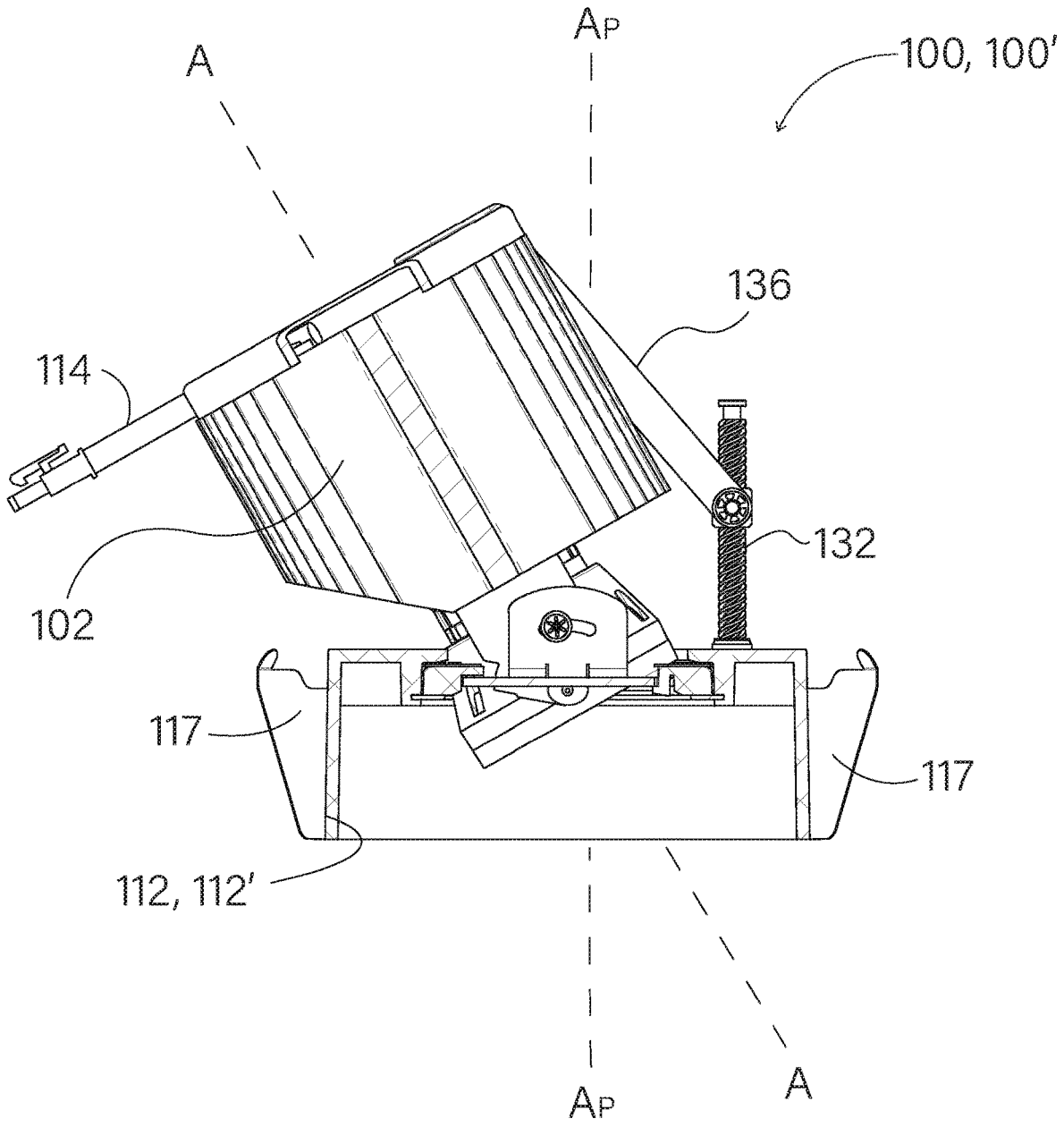
FIG. 4 is a cross-section, side view corresponding to the lighting device assembly in FIG. 1, and to an assembled lighting device assembly in FIGS. 2 and 3.
Figure 5:
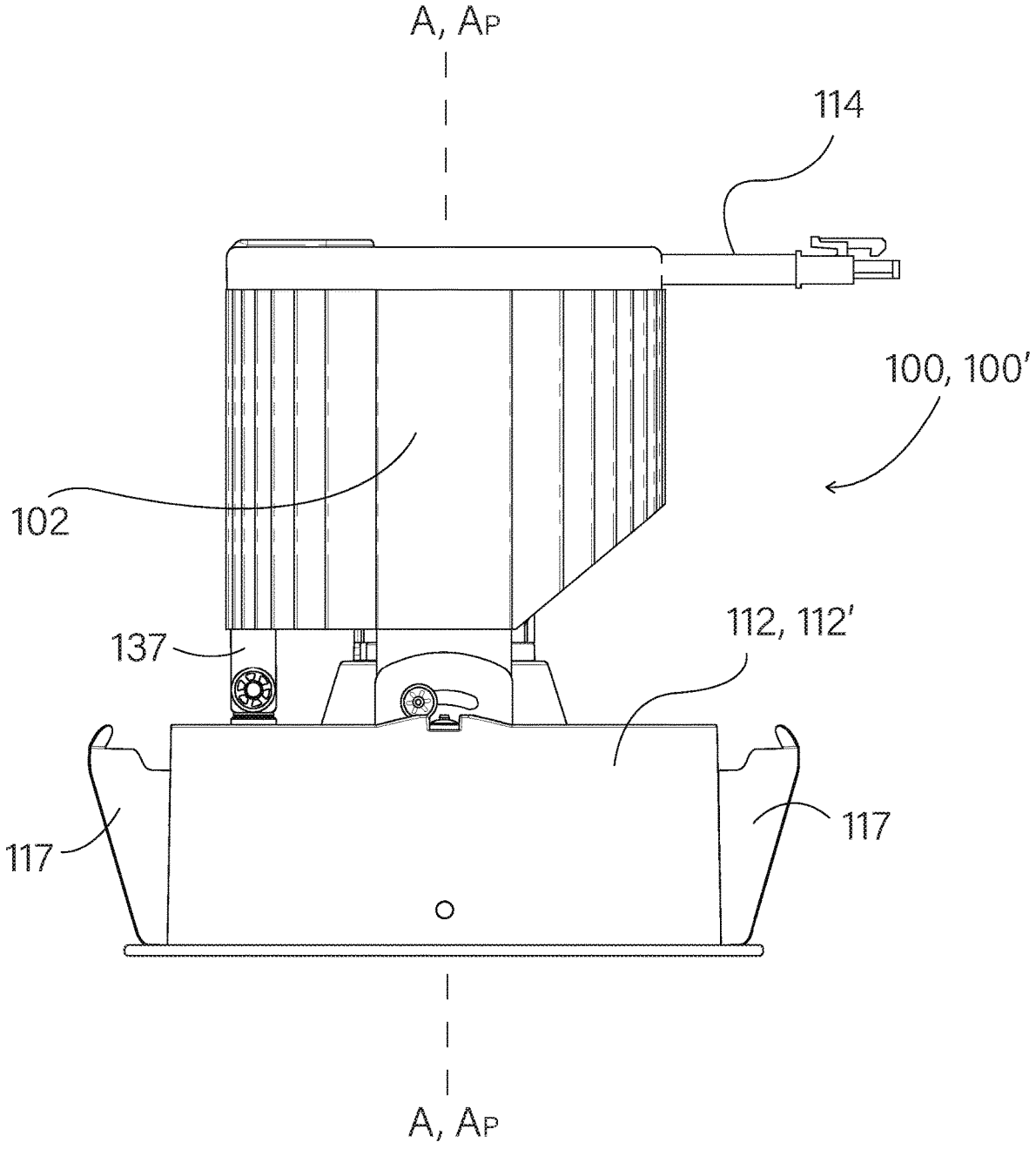
FIG. 5 is another side view corresponding to the lighting device assembly in FIG. 1, and to an assembled lighting device assembly in FIGS. 2 and 3, with the axis A of the lighting device assembly in a different orientation relative to FIG. 4.

FIG. 1 is a perspective view of an example of a lighting device assembly 100 having a generally cuboidal-shaped mounting housing. FIG. 2 is an exploded, perspective view of a lighting device assembly 100', showing certain components of the lighting device assembly 100' separated along an axis A, and having generally cylindrical-shaped mounting housing. The lighting device assembly 100' is similar to the lighting device assembly 100, but has a cylindrical mounting, while the lighting device assembly 100 has a rectangular cuboid mounting housing. FIG. 3 is another exploded, perspective view of the lighting device assembly 100' of FIG. 2, showing the components separated along the axis A, but from a different perspective angle relative to FIG. 2. FIG. 4 is a side view of the lighting device assembly 100 or 100' of FIGS. 1-3 at an adjusted angle, and with a cross-section taken through a portion of the mounting housing. FIG. 5 is a side view of the lighting device assembly 100 or 100' of FIGS. 1-3, at a different adjusted angle relative to FIG. 4. FIGS. 6-11*b* are additional views of components of the lighting device assembly 100.

Each of the lighting device assemblies 100 and 100' includes a heat sink member 102, an optic member 104, an optic holder 106, a light source 108, a light source mounting frame 109, a trim member 110 (or 110'), a trim member insert 111 (or 111'), and a mounting housing 112 (or 112') having a rotary base plate 113 as described below. In other examples, one or more of the optic holder 106, the trim member 110, 110', the trim member insert 111, 111', the mounting housing 112, 112', or the base plate 113 may be omitted.

Figure 9:
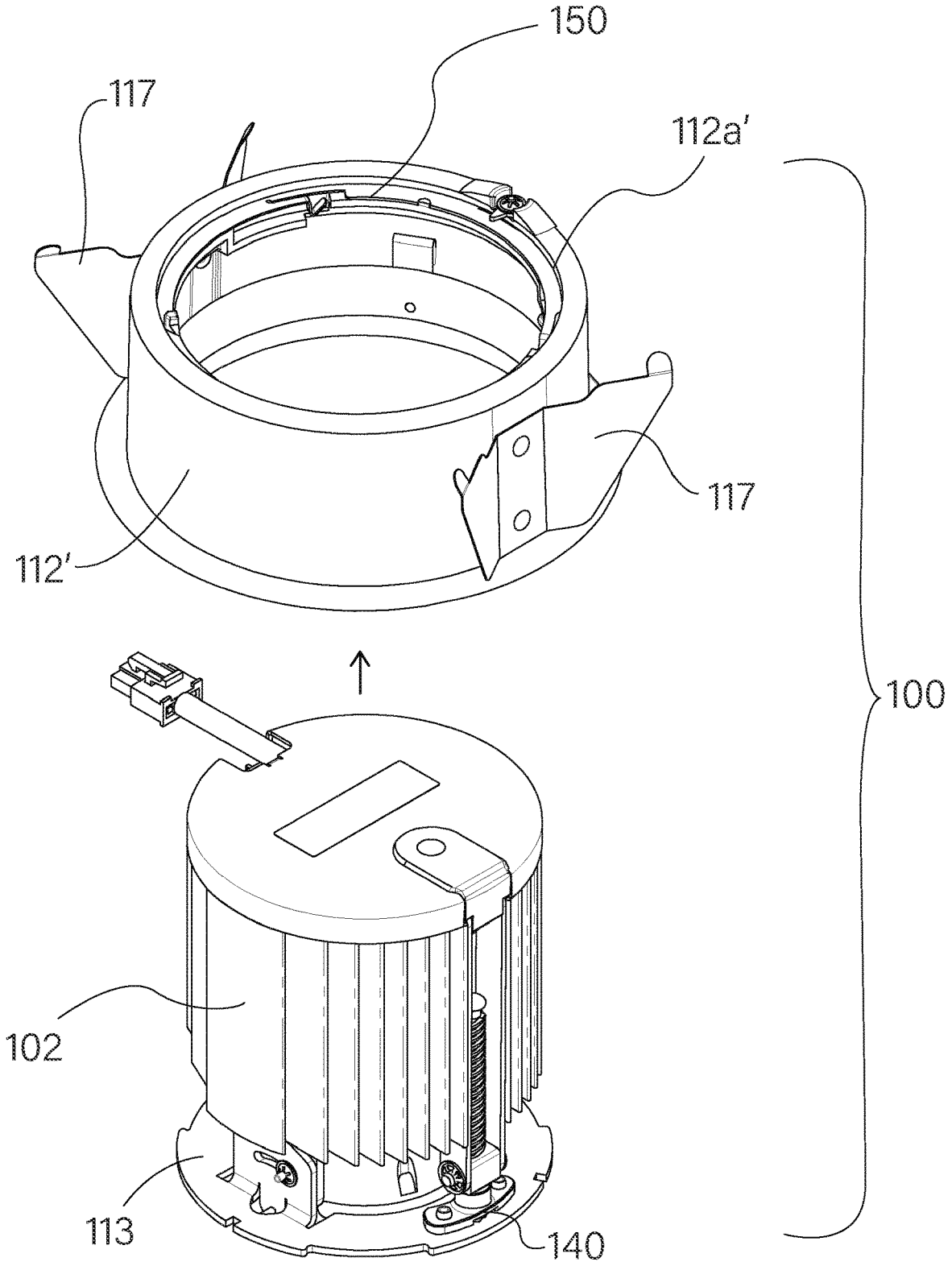
FIG. 9 is a partial exploded, perspective view of an assembled lighting device assembly with a mounting housing of FIGS. 2 and 3.

The mounting housing 112, 112' includes a generally rigid housing structure having an outer dimensions and shape generally corresponding to the shape of an opening in a ceiling, wall, outer housing, or other object, and is configured to fit within (and be mounted within) that opening. The mounting housing 112,112' may have any suitable outer peripheral shape and, in particular examples, is has a shape configured to easily fit into mounting locations for light fixtures. Typical mounting locations include rectangular or round apertures in which the mounting housing 112, 112' is fitted and mounted. Accordingly, in some examples, the mounting housing 112 may have a rectangular or cuboid box shape with four side walls, a top wall and an open bottom (facing downward in those drawings), such as shown in FIGS. 1, 4, 5 and 8. In other examples, the mounting housing 112' may have a cylindrical shape with an open end (the end facing downward in the drawings) such as shown in FIGS. 2, 3 and 9. Other mounting housing examples may include other suitable dimensions and shapes.

The mounting housing 112, 112' may be made of any suitably rigid material or materials including, but not limited to metal, plastic, ceramic, composite material, or combinations thereof. In certain examples, the mounting housing 112, 112' has one or more spring clips 117 (two shown in the illustrated examples) or other clips, brackets or other mounting mechanisms to secure the mounting housing 112, 112' to the ceiling, wall, outer housing, or other object, when fitted within the opening. The one or more spring clips or other mounting mechanisms may be secured to the mounting housing 112, 112' by suitable fasteners or may be formed integral with the mounting housing.

The top wall of the mounting housing 112, 112' has a circular opening in or adjacent which the base plate 113 is held for rotation about the second adjustment axis $A_p$. In particular examples, the base plate 113 has a thin, generally circular, annular disc shape, with a central opening 113*a*. The base plate 113 may be made of any suitably rigid material or materials including, but not limited to metal, plastic, ceramic, composite material, or combinations thereof. As described herein, the base plate 113 supports the heat sink member 102 on the mounting housing 112, 112'.

The heat sink member 102 may be composed of a body of generally rigid material having good thermal conductivity characteristics to efficiently conduct heat. In certain examples, the heat sink member 102 includes a single, unitary block or plate of aluminum, copper or other metal having significant or substantially great heat conduction capabilities. In certain examples, the heat sink 102 may be formed (e.g., cast or forged) from solid aluminum. However, in other examples, the heat sink member 102 may be composed of other materials or of multiple parts that are fixed or connected together to form a heat sink structure as described herein.

In the illustrated example, the body of the heat sink member 102 has a generally cylindrical shape with fins for further heat dissipation. In other examples, the heat sink member body may have a cuboid, block or brick shape with or without fins. In yet other examples, the heat sink member body may have other suitable shapes with or without fins. The shape of the body of the heat sink member 102 defines an axis A (which may correspond to an axis of a cone or pattern of light emitted from the light source 108). In certain examples, the heat sink member 102 may have an angled surface or have an angled recess 102*a* on one end (the lower end in FIGS. 4 and 5) and on one side of the axis A, to increase the range of angles to which the heat sink member 102 (or axis A) may be adjusted and oriented, as described herein.

The heat sink member 102 includes a surface 102*b* on which a light source 108 is mounted. The light source 108 is arranged to emit light outward from the surface 102*b*, toward the optic member 104. As described herein, the light source 108 and the optic member are configured to emit light in a cone or other pattern having an axial direction or light emission direction.

In particular examples, the light source 108 is fixed to and mounted in thermal communication with the surface 102*b* of the heat sink member 102, such that the heat sink member 102 may efficiently receive and conduct heat from the light source 108. In certain examples, the surface 102*b* of the heat sink member 102 may be in direct contact with the light source 108, to efficiently transfer heat away from the light source 108. In certain examples in which the light source 108 includes a circuit board on which one or more light emitting devices are mounted, the circuit board may be mounted in direct contact with (e.g., generally flat or flush against the surface 102*b*) to enhance the ability to transfer heat from the circuit board (or components on the circuit board) to the heat sink member 102.

The light source 108 is secured to the heat sink member 102 by a frame member 109. The frame member 109 may include an annular member having a central opening or light passage, and may secure to the heat sink member 102 by one or more suitable fasteners (not shown) such as, but not limited to screws, bolts or other threaded fasteners, clips, friction fitting, adhesives or combinations thereof. In particular examples, the light source 108 is arranged between the frame member 109 and the heat sink member 102 such that, when the frame member 109 is secured to the heat sink member 102, the frame member 109 firmly clamps and holds the light source 108 against the surface 102*a* of the heat sink member 102. When secured on the heat sink member 102, the light source 108 is oriented to emit light through the central opening or light passage of the frame member 109, toward the optic 106.

The light source 108 may include any suitable light emitting device or devices. In particular examples, the light source 108 includes one or more LEDs or other light source that generates heat during operation. In such examples, the one or more LEDs (or other light source) may be mounted on a circuit board or other support structure. As described herein, the heat sink member 102 is configured to conduct and dissipate heat away from the light source 108, which can significantly improve the efficiency and light output of the one or more LEDs (or other heat-generating light sources). While particular examples described herein include a light source 108 having one or more LEDs, other examples may include other suitable light sources such as, but not limited to one or more halogen, halide, fluorescent, or incandescent light sources, or other electrical discharge or electroluminescence device, or the like.

The heat sink member 102 may include one or more passages through which one or more electrical wires or other electrical conductors 114 extend. The electrical wires or other conductors 114 connect to the light source 108 located on the heat sink member 102, and extend out of an opening in the first heat sink member 102 to a suitable driver circuit, control electronics and/or power supply. In some examples, the body of the heat sink member 102 has one or more openings through which the electrical wires or other conductors 114 extend, and an end cap 116 may be provided over the opening(s). The end cap 116 may be secured to the heat sink member 102 by suitable fasteners or may be formed integral with the heat sink member.

In various examples, the wires or other conductors 114 may include or be configured to connect to a source of electrical power (not shown) through a driver and/or other electronics (not shown) to convert power provided from the power source to a suitable power for driving the light source 108. In other examples, some or all of the driver and electronics may be provided on the light source 108 (e.g., on a circuit board of the light source 108), or in another electronic circuit located on the heat sink member 102. In yet other examples, some or all of the driver and electronics may be located separate from the heat sink member 102, and connected to the light source 108 on the heat sink member 102 through electrical wires or other conductors 114. In examples in which the light source is an LED light source, the driver and electronics may include an LED driver to convert the power from the power source to a low-voltage power suitable to drive the LED light source. In some examples, the driver or electronics may include a processor to execute instructions stored on memory (e.g., non-transient computer readable media) to process data and/or to control various functions of the lighting device (e.g., temperature, light output, color of light, direction of light, focus of light, and/or the like).

The optic member 104 may held by the optic holder 106, which is configured to be secured to the first heat sink member as described herein. The optic member 104 has a lens body through which light may pass. The lens body of the optic member 104 may be made of any suitable material that passes and directs light such as, but not limited to plastic, glass or other ceramic, composite material, or combinations thereof. The optic member 104 has a light entry side (the side facing upward in the orientation of FIG. 3) and a light exit side (the side facing downward in the orientation of FIG. 3).

The optic member 104 is configured to direct light from the exit side, through the light passage aperture or opening in the first side of the first heat sink member 102 and the aligned openings in the trim 108. In particular examples, the optic member 104 is configured to focus and direct light in a manner to pass most of the light emitted from the light source 108 through an opening in the trim member 110, 110'. In certain examples, some of the light passing through the optic member 104 may be focused by the optic member 104 to one or more focus points along the axis A, where the light rays may form a cone that expands outward from the focus point(s) to illuminate a larger area than the area of the relatively small light passage aperture of the trim member 110, 110'. In certain examples, another portion of the light passing through the optic member 104 is directed along or substantially parallel to the axis A. The optic member 104 may be made of any suitably transparent or partially transparent material such as, but not limited to, plastic, glass, ceramic, or combinations thereof.

The optic member 104 may be held by and secured to the heat sink member 102 by the optic holder 106. In the example shown in FIGS. 1-5, the optic member 104 is arranged adjacent the light source 108 and attached to the surface 102*b* of the first heat sink member 102. The optic holder 106 is configured to secure and hold the optic member 104 in place, adjacent the light source 108. In certain examples, the optic holder 106 may include an annular shell that surrounds or partially surrounds an outer peripheral surface of the optic member 104, but does not cover the light entry side or the light exit side of the optic member 104. One end of the optic holder 106 may include one or more connection features (such as, but not limited to tabs, rims, lips, protrusions, recesses, openings or grooves) that engage with one or more corresponding connection features (such as, but not limited to tabs, rims, lips, protrusions, recesses, openings or grooves) on the frame member 109 (or on the heat sink member 102), to selectively connect the optic holder 106 (and the optic 104) to the optic holder 106 (or the heat sink member 102). The optic holder 106 may be made of any suitable rigid material such as, but not limited to plastic, metal, ceramic, composite material, combinations thereof or the like.

The trim member 110, 110' includes an annular body that has a barrel section, an annular flange and a central opening through the barrel section and the annular flange. In FIG. 3, an example of a trim member 110' is shown, with a generally cylindrical barrel section 110'*a*, a circular annular flange 110'*b*, and a central opening 110'*c*. The trim member 110 may have a similar-shaped barrel section and central opening, but may have a rectangular annular flange. The barrel section 110'*a* may have a diameter configured to fit inside the inner diameter of the central opening of the mounting housing 112' (or 112) and attach to the inner surface of the mounting housing 112' (or 112). In certain examples, one or more fasteners (not shown) may be employed for securing the barrel section 110'*a* of the trim member to the mounting housing 112' (or 112) such as, but not limited to such as, but not limited to screws, bolts or other threaded fasteners, clips, friction fitting, adhesives or combinations thereof. In other examples, the barrel section 110'*a* may secure to the outer surface or other surface of the mounting housing. In certain examples, the annular flange may be configured to be arranged in contact with an exposed surface of a ceiling, wall or other structure, when the lighting device assembly is an installed state, in an opening in the ceiling, wall or other structure. The flange 110'*b* may cover one or more edges of the opening in the ceiling, wall or other structure, when the lighting device assembly is in an installed state. The trim member 110' may be made of any suitably rigid material such as, but not limited to, metal, plastic, ceramic, composite material, or combinations thereof.

The trim member insert 111, 111' includes an annular shaped body that has a central opening. The trim member insert 111 has an outer peripheral shape and size that corresponds to the inner peripheral shape and size of the central opening in the trim member 110, to allow the trim member insert 111 to fit within the trim member 110 from the flange side of the trim member 110. Similarly, the trim member insert 111' has an outer peripheral shape and size that corresponds to the inner peripheral shape and size of the central opening in the trim member 110' to fit within the trim member 110' from the flange side of the trim member 110'.

In certain examples, the trim member insert 111, 111' includes one or more clips 111'*a* secured to the outer surface of the trim member insert 111. 111', for securing the trim member insert 111, 111' to the inner surface of the trim member 110, 110', when the trim member insert 111, 111' is received within the central opening 110'*c* of the trim member 110, 110'. In other examples, other suitable fasteners may be provided for securing the trim member insert 111, 111' within the trim member 110, 110', including but not limited to screws, bolts or other threaded fasteners, other clips, friction fitting, adhesives or combinations thereof. When the trim member insert 111, 111' is received in the trim member 110, 110', the central openings of the trim member insert 111, 111' and the trim member 110, 110' are arranged in alignment (e.g. coaxially) with each other and with the optic member 104, to pass light emitted through the optic member 104.

In certain examples, the trim member insert 111, 111' may include a tapered inner surface, tapering between a large opening end (facing downward in FIG. 3) and a small opening end (facing upward in FIG. 3). The trim member insert 111, 111' may be made of any suitably rigid material such as, but not limited to, metal, plastic, ceramic, composite material, or combinations thereof. In some examples, the inner surface of the trim member insert 111, 111' is reflective or has a coating or treatment to enhance reflection of light. In those or other examples, the trim member insert 111, 111' may have an ornamental or decorative shape, color, coating, combination thereof, or the like.

In some examples, the trim member insert 111, 111' may be configured to receive and hold a further optic member (such as, but not limited to the further optic 180 or 180' described below). In such examples, the trim member insert 111, 111' may be configured with one or more connection features (such as, but not limited to tabs, rims, lips, protrusions, recesses, openings or grooves) that engage with one or more corresponding connection features (such as, but not limited to tabs, rims, lips, protrusions, recesses, openings or grooves) on the further optic, to selectively connect the further optic to the trim member insert 111, 111', in alignment with the aligned light passage openings in the trim member insert 111, 111' and the trim member 110, 110'.

Screw Drive Angle Adjustment

In the example of FIGS. 1-5, the heat sink member 102 is supported on the base plate 113 by a support structure 120. The support structure 120 allows the angle or direction of orientation of the heat sink member 102 to be adjusted about a first adjustment axis $A_f$ and held in an adjusted position. The lighting device assembly 100 further includes a drive mechanism 130 for selectively driving or moving the heat sink member 102 to adjust the direction or angle of orientation of the heat sink member 102 about the first adjustment axis, while the heat sink member 102 is supported by the support structure 120. By adjusting the orientation of the heat sink member 102 about and relative to the first adjustment axis, the angle or the direction of light emitted from a light source 108 affixed to the surface 102*b* of the heat sink member 102 is selectively adjustable about the first adjustment axis.

In certain examples, the base plate 113 is supported for rotation about a second adjustment axis $A_p$ that is transverse to the first adjustment axis $A_f$, as shown in FIG. 1. Further views of the mounting housing 112, 112' and the axis $A_p$ are shown in FIGS. 4 and 5. By rotating the base plate about a second adjustment axis $A_p$, the orientation of the heat sink member 102, and the angle or the direction of light emitted from a light source 108, is selectively adjustable about the second adjustment axis $A_p$. Certain examples allow for adjustment about the first adjustment axis $A_f$ and also about the second adjustment axis $A_p$, to provide a large range (or a desired range) of adjustability of the angle or the direction of light emitted from a light source 108 about multiple axes.

Figure 6A:
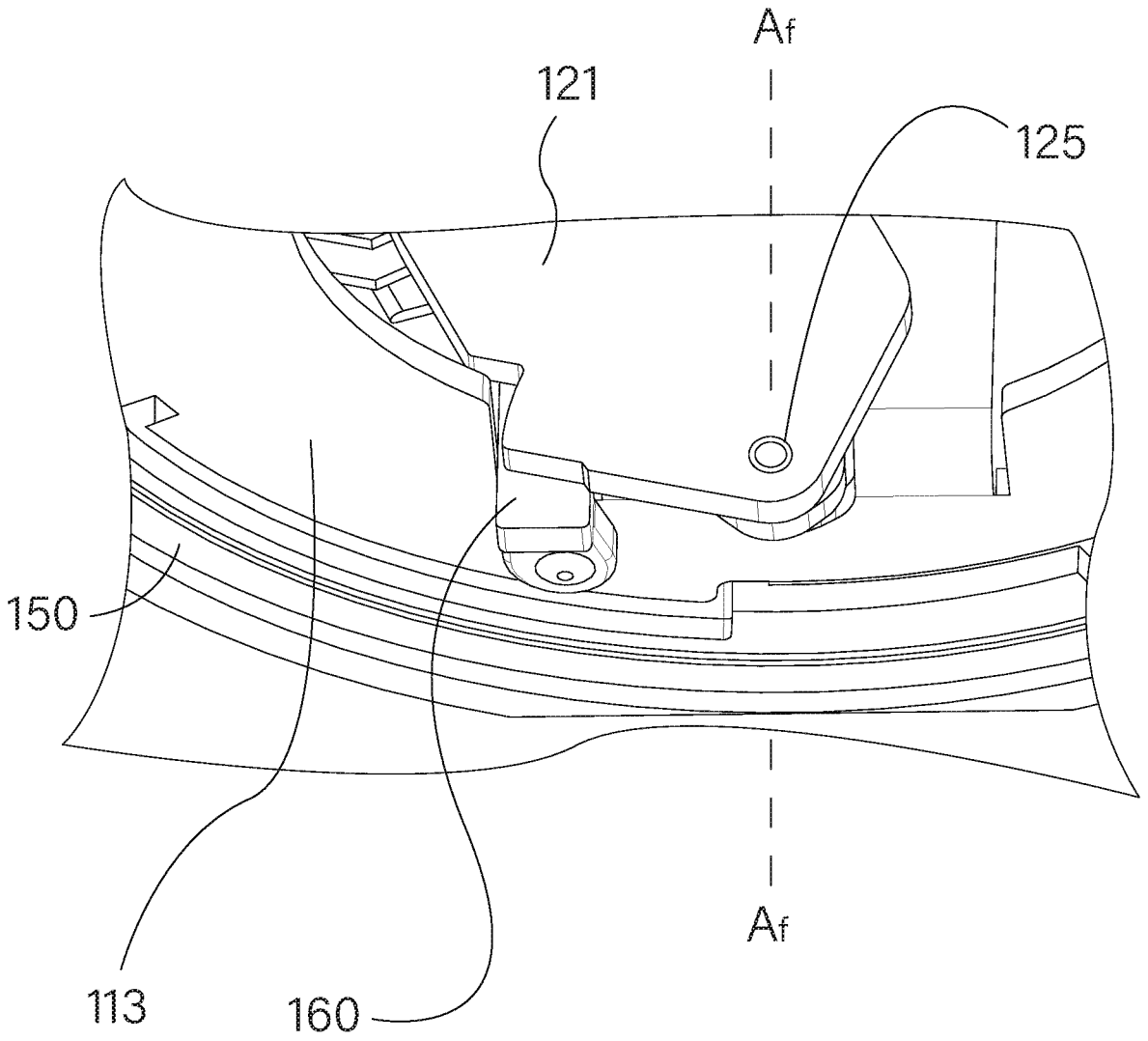
FIGS. 6*a* and 6*b* are partial cross-section views of a portion of the lighting device assembly, taken along the partial cross-section lines 6*a,b*-6*a,b* in FIG. 9.
Figure 6B:
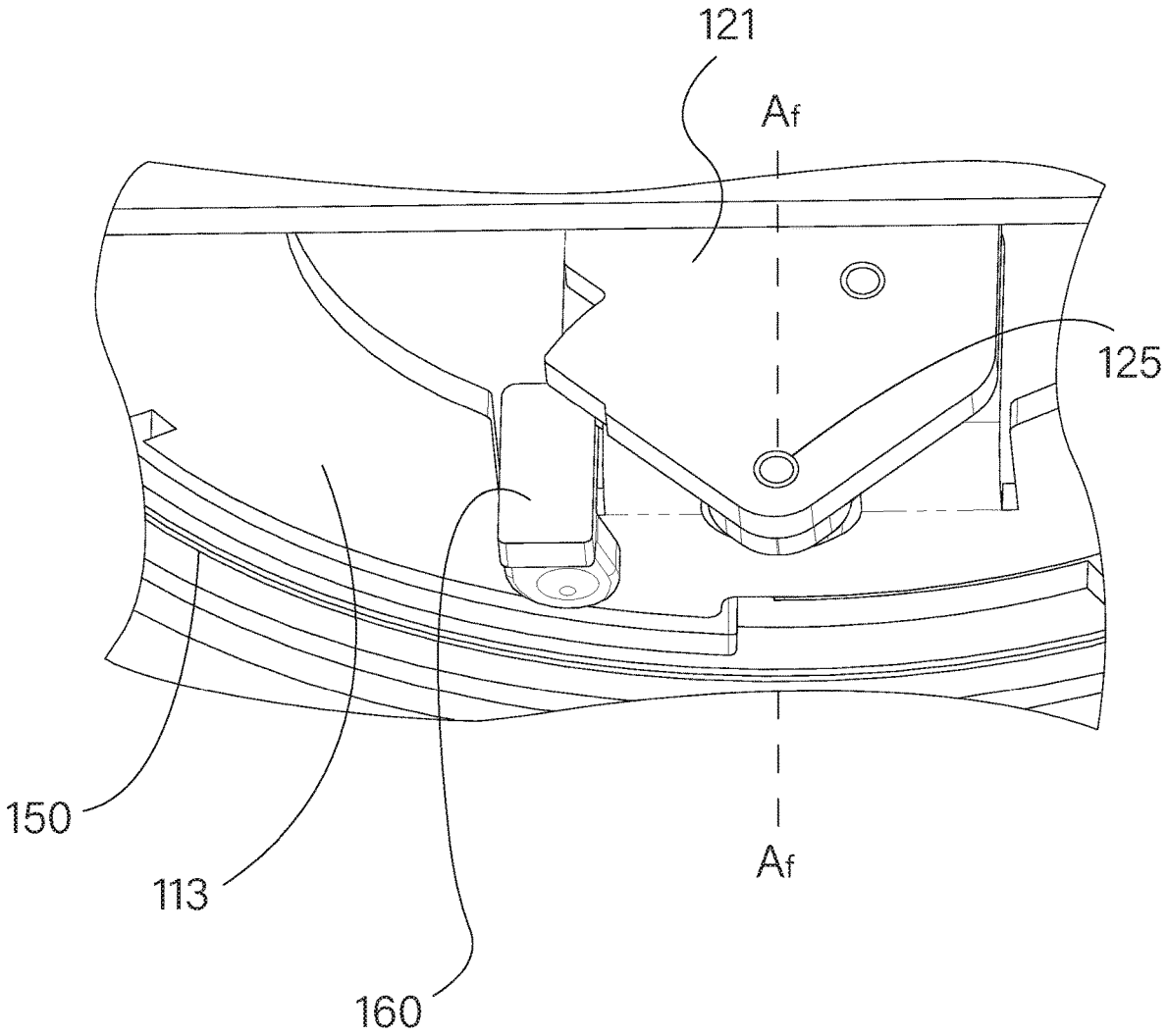

In certain examples, the heat sink support structure 120 includes at least one flange (e.g., first and second flanges 121 and 122) extending from the heat sink member 102. The flanges 121 and 122 are connected to the heat sink member 102 by suitable fasteners, or are formed integral on the heat sink member 102. The flanges 121 and 122 extend from one end (the lower end in FIGS. 1-5) of the heat sink member 102. In particular examples, the flanges 121 and 122 are made of generally rigid material having good thermal conductivity characteristics to efficiently conduct heat from the heat sink member 102 such as, but not limited to metal, ceramic, thermally conductive polymer or the same material from which the heat sink member 102 is made. The flanges 121 and 122 are located on opposite sides of the central axis A of the heat sink member 102. Each flange 121 and 122 is connected to and supported by the base plate 113 through a hinge or pivot joint 125 or 127 (FIGS. 2, 6*a* and 6*b*) that allows the flange (and the heat sink member 102) to pivot about the first adjustment axis $A_f$. (The views in FIGS. 6*a* and 6*b* are taken at a partial cross-section of FIG. 10, discussed below, as represented by the line 6*a*,6*b* in FIG. 10.) The axis $A_f$ is transverse (such as, but not limited to, perpendicular) to the axis A of the heat sink member 102. The axis $A_f$ is also transverse (such as, but not limited to, perpendicular) to the second adjustment axis $A_p$ of rotation of the rotary base plate 113 on which the heat sink member 102 is supported.

Figure 7:
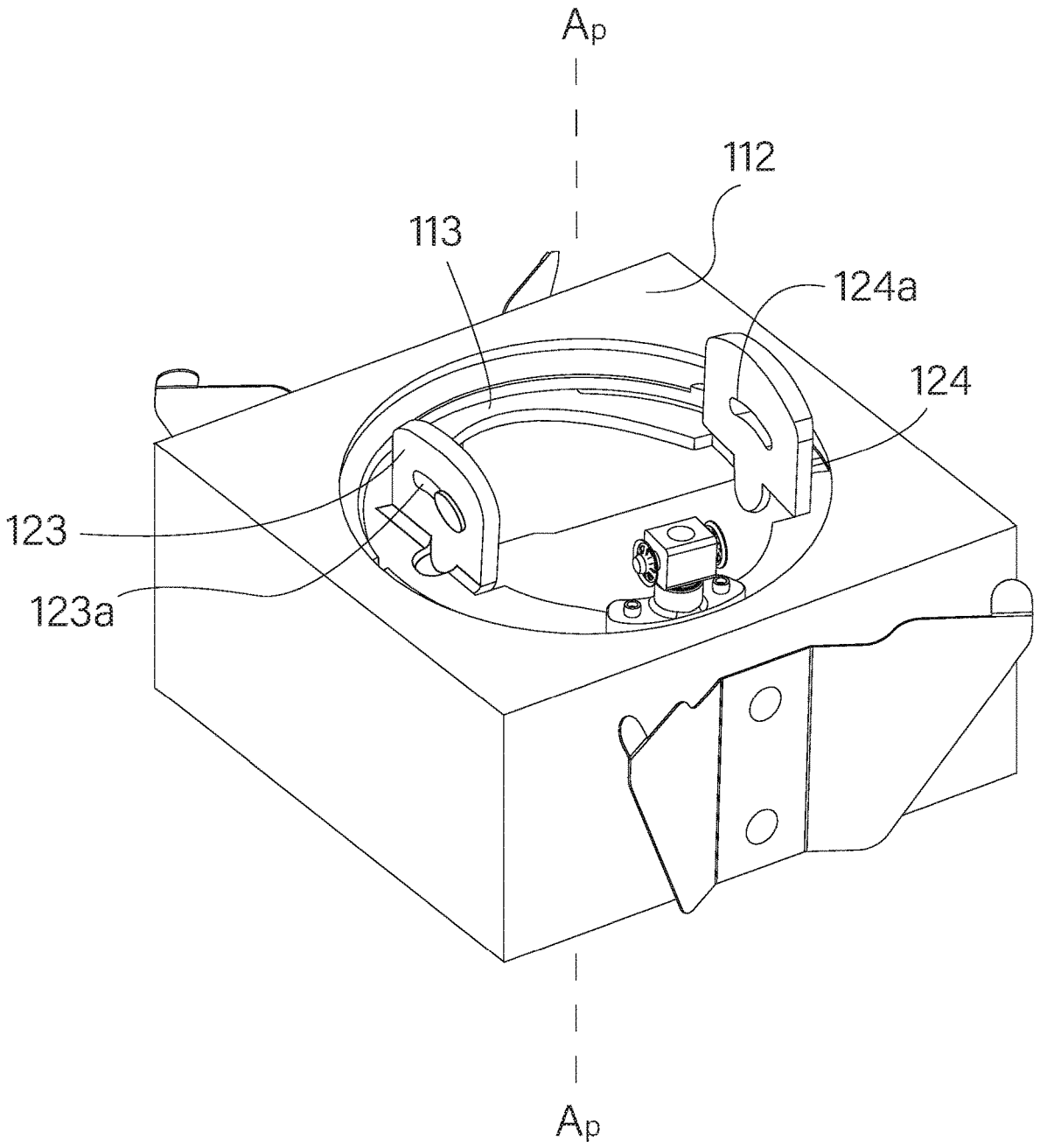
FIG. 7 is a partial perspective view of a portion of a mounting housing for a lighting device assembly of FIG. 1.
Figure 8:
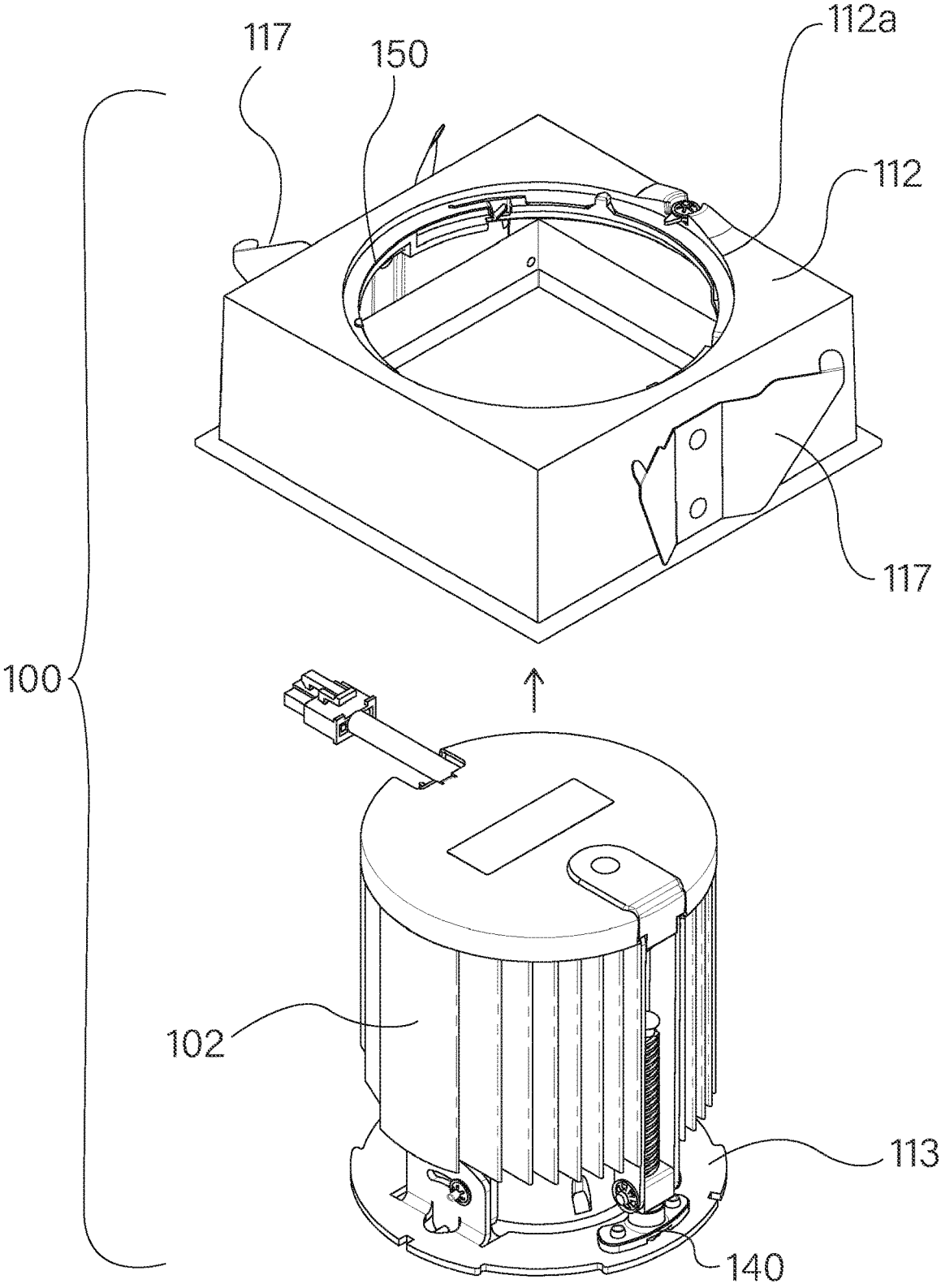
FIG. 8 is a partial exploded, perspective view of a lighting device assembly with a mounting housing of FIG. 1.

The example in FIGS. 1-5 further includes third and fourth flanges 123 and 124 extending from the base plate 113 (also shown in FIG. 7. In examples in which the mounting housing 112 or the base plate 113 is omitted, the third and fourth flanges 123 and 124 may extend from other mounting structure. In particular examples, the flanges 123 and 124 are made of generally rigid material having good thermal conductivity characteristics to efficiently conduct heat from the first and second flanges 121 and 122, such as, but not limited to metal, ceramic, thermally conductive polymer, or the same type of material from which the flanges 121 and 122 are made. The flanges 123 and 124 are located on opposite sides of the central opening in the base plate 113.

The first, second, third and fourth flanges 121-124 are arranged with a surface of the first flange 121 facing and abutting (in sliding contact with) a surface of the third flange 123, while a surface of the second flange 122 is facing and abutting (in sliding contact with) a surface of the fourth flange 124. One of the first and third flanges 121 and 123 has a curved slot-shaped opening (e.g., shown as opening 123*a* of the flange 123 in FIGS. 1-5 and 7). The other of the first and third flanges 121 and 123 (e.g., flange 121 in FIG. 1-5) has an extension portion or pin (e.g., extension 121*a*) extending toward and into (or through) the curved slot-shaped opening (e.g., opening 123*a*). Similarly, one of the second and fourth flanges 122 and 124 has a curved slot-shaped opening (e.g., shown as opening 124*a* of the flange 124 in FIGS. 1-5 and 7), while the other one of the second and fourth flanges 122 and 124 (e.g., flange 122 in FIG. 1-5) has an extension or pin (e.g., extension 122*a*) extending toward and into (or through) the curved slot-shaped opening (e.g., opening 124*a*).

In certain examples, one or each of the extensions or pins 121*a* and 122*a* may include an enlarged head or end section located adjacent the outer-facing surface of the flanges 123 and 124. The enlarged head or end section of the extension or pin 121*a* and 122*a* is larger in a width dimension than the width corresponding width dimension of the curved, slot-shaped opening 123*a* and 124*a*. The enlarged head or end section of the extension or pin 121*a* and 122*a* abuts against an outward-facing surface of the flanges 123 and 124 to help press together, and maintain a constant contact between the facing surfaces of the flanges 121 and 123 and between the facing surfaces of the flanges 122 and 124.

In particular examples, the contacting surfaces of the flanges increase the thermal conduction between contacting flanges 122 and 124 and between contacting flanges 121 and 123. Alternatively or in addition, the contacting surfaces of the flanges help to increase frictional resistance to the pivotal movement of the heat sink member 102 (e.g., frictional resistance that can hold the heat sink member 102 in an adjusted pivoted position against gravity, but that can be overcome by manual force to move or adjust the pivoted position by a user). Alternatively or in addition, frictional resistance to the pivotal movement of the heat sink member 102 (to hold the heat sink member 102 against gravity, in any adjustable angle of the axis A) may be provided by the hinge or pivot joints 125 and 127.

In certain examples, each extension or pin 121*a* and 122*a* may include a threaded screw or bolt that is coupled (by threading connection) with a threaded opening in the associated flange 121 or 122 to secure the extension or pin to the flange and/or to adjust the frictional force between contacting flanges 122 and 124 and between contacting flanges 121 and 123. In other examples, each extension or pin 121*a* and 122*a* may be formed integral with the associated flange 121 or 122, extends through the curved slot-shaped opening 123*a* or 124*a* in the flange 123 or 124, and is threaded or formed to receive a threaded nut or cap adjacent the outer-facing surface of the flange 123 or 124. In other examples, other configurations for coupling or arranging the flanges 121 and 123 in sliding contact with the flanges 122 and 124, respectively, as the angle of the axis A of the heat sink member 102 is adjusted.

In the example in FIGS. 1-5, the first and second flanges 121 and 122 are arranged between the third and fourth flanges 123 and 124, with the extension or pin 121*a* extending outward, through the opening 123*a* in the flange 123, and with the extension or pin 122*a* extending outward, through the opening 124*a* in the flange 124. In other examples, the flanges, the extensions or pins, and the curved, slot-shaped openings may be provided in other suitable arrangements. Specifically, in other examples, the third and fourth flanges 123 and 124 are arranged between the first and second flanges, with the extension or pin 121*a* extending inward, through the opening 123*a*, and with the extension or pin 122*a* extending inward, through the opening 124*a*. In yet other alternative examples, the first and third flanges 121 and 123 are arranged between the second and fourth flanges 122 and 124 (or the second and fourth flanges 122 and 124 are arranged between the first and third flanges 121 and 123).

In further alternatives of any of those examples, the extensions or pins may extend from the flanges 123 and 124 toward and through curved, slot-shaped openings in the flanges 121 and 122 (or one extension or pin from one of the flanges 123 or 124 extends through a curved, slot-shaped opening in one of flanges 121 or 122 while another extension or pin from the other one of the flanges 121 or 122 extends through a curved, slot-shaped opening in the other one of the flanges 123 or 124). In each of those example arrangements, the curved, slot-shaped openings (e.g., 123*a* and 124*a*) help guide the extensions or pins (e.g., 121*a* and 122*a*), as the heat sink member 102 is moved (pivoted) through a range of angular motion. By moving through a range of angular motion, the angle of the axis A of the heat sink member 102 is changed or adjusted as shown in FIGS. 4 and 5. The angle of the axis A may be measured as an angle relative to any suitable reference line or angle, such as, but not limited to the vertical, top-down orientation of the heat sink member 102 shown in FIGS. 2, 3 and 5 (or a reference angle perpendicular to a top surface of the mounting housing 112, 112') being an orientation where the axis A equals zero degrees (0°).

In certain examples, the heat sink member 102 moves (pivots) about the pivot axis $A_f$ through a range of angular motion defined by the length of the curved, slot-shaped opening 123*a* and 124*a*. In some examples, the range of angular motion may extend from a first position or angle of the axis A when the extensions or pins 121*a* and 122*a* are at one end of the curved, slot-shaped openings 123*a* and 124*a*, to a second position or angle of the axis A when the extensions or pins 121*a* and 122*a* are at a second (opposite) end of the curved, slot-shaped openings 123*a* and 124*a* (as shown in FIGS. 4 and 5). Accordingly, the direction or angle of the axis A of the heat sink member 102 may be pivotally moved to any suitable direction or angle including or between the first and second angles, to change or adjust the direction or angle of light emitted from the light source 108 affixed to the heat sink member 102 (e.g., relative to a reference direction or angle). For example, a reference or zero degrees (0°) orientation of the axis A of the heat sink member 102 may be at any location at or between the first and second positions or angles, such as, but not limited to, the center point between the first and second positions or angles.

In certain examples, the curved, slot-shaped openings 123*a* and 124*a* may have a radius of curvature corresponding to the radius of pivotal movement of the heat sink member about the first adjustment axis $A_f$. In other examples, the slot-shaped openings 123*a* and 124*a* and the pins or extensions 121*a* and 122*a* may be omitted and, instead, the flange 121 may be abutted against and frictionally engage the flange 123 and the flange 122 may be abutted against and frictionally engage the flange 124 by virtue of the respective sizes and positions of the flanges. In yet other examples, the flanges 123 and 124 may be omitted.

The drive mechanism 130 is configured for selectively driving or moving the heat sink member 102 to adjust the angle of the axis A of the heat sink member 102 about the first adjustment axis $A_f$. The drive mechanism 130 includes a threaded drive screw 132, a threaded collar 134, one or more struts (two struts 136 and 137 in the example in FIGS. 1-5), and hinge or pivotal joints 133 and 135. The hinge or pivotal joints 133 and 135 are represented in FIGS. 2 and 3 as axle openings in the struts 136 and 137, through which a hinge axle may extend. In those or other examples, the pivotal joints 133 and 135 may include a hinge axle (not shown) and hardware for pivotally securing the struts 136 and 137 to the threaded nut 134 and to the heat sink member 102. Similarly, the hinge or pivotal joint 125 in FIGS. 2, 3, 6*a* and 6*b* (and corresponding pivotal joint 127 in FIGS. 2 and 3) is represented as an axel or axel opening for receiving a hinge axel in the flanges 121 and 122. In other examples, other hinge or pivotal joint structures may be employed for the hinge or pivotal joints 133, 135, 125 or 127.

The drive screw 132 may include a cylindrical shaft having a lengthwise axis $A_d$ and a thread pattern on the outer surface of at least a portion of its length dimension. The drive screw 132 is held by the base plate 113 of the mounting housing 112. In certain examples, the drive screw 132 is held by a rotary mount 140 that is mounted to the base plate 113 by suitable fasteners, or is formed integral with the base plate. In other examples in which the mounting housing 112 or the base plate is omitted, the drive screw 132 may be held by other suitable mounting structure.

The drive screw 132 is supported for rotation about its lengthwise axis $A_d$. The threaded collar 134 is threaded onto the drive screw 132 and is driven in a linear direction of the axis $A_d$ of the drive screw 132, as the drive screw 132 is rotated. As described herein, linear movement of the threaded collar is translated to angular movement of the heat sink member 102, through the struts 136 and 137, to adjust the angle of the axis A of the heat sink member 102.

In particular examples, the drive screw 132 may be made of a rigid metal. In other examples, the drive screw may be made of other suitable, rigid materials such as, but not limited to plastic, ceramic, composite material, or combinations thereof. The drive screw 132 is supported for rotation about the axis $A_d$, while the position and angle of the axis $A_d$ remains fixed relative to the base plate 113 (or other mounting structure).

In the example in FIGS. 1-5, the drive screw 132 is supported with the axis $A_d$ directed vertically. Such an orientation may correspond, for example, to an example in which the mounting housing 112, 112' (or other mounting structure) is configured to be mounted in a recess or opening of a ceiling. In other examples, the drive screw 132 may be supported with the axis $A_d$ directed horizontally, such as, but not limited to, contexts in which the mounting housing 112, 112' (or other mounting structure) is configured to be mounted in a recess or opening of a vertical wall or other vertical object. In yet other examples, the drive screw 132 may be supported with the axis $A_d$ directed at other angles (e.g., an oblique angle relative to a horizontal or vertical plane).

The shaft of the drive screw 132 includes a first length portion 132*a* having threads in a thread pattern that mates with threads on the threaded collar 134. In particular examples described herein, the thread pattern may be configured (as to a number of thread starts, a pitch and a diameter) to provide a desired or improved operation feel and efficiency. The drive screw 132 includes a second length portion 132*b* that extends through a channel in the rotary mount 140. In particular examples, the second length portion 132*b* is smooth and has no threads, or has another rib or thread pattern that allows the drive screw 132 to rotate about the axis $A_d$ without moving linearly in a direction of the axis $A_d$ relative to the rotary mount 140. Accordingly, the drive screw 132 is held and supported by the rotary mount 140 for rotation about the axis $A_d$ and is inhibited from moving linearly in a direction of the axis $A_d$ relative to the rotary mount 140.

The drive screw 132 may include a shoulder portion 132*c* located between the threaded portion 132*a* and the second portion 132*b*, where the shoulder portion 132*c* has a larger radial or circumferential dimension than the second portion 132*b*. The shoulder portion 132*c* of the drive screw 132 may be located outside of, and adjacent to the rotary mount 140, to inhibit movement of the drive screw 132 further into the rotary mount 140 (in the downward direction in FIGS. 1-5).

In particular examples, the drive screw 132 may include a head portion 132*d* located at one end of the threaded portion 132*a*. The head portion 132*d* may be configured to form a stop surface that abuts the threaded collar 134 and inhibits further linear movement of the threaded collar 134 in one direction of the axis $A_d$, when the threaded collar 134 has reached the end of the threaded portion 132*a* in its linear movement in the one direction (e.g., the upward direction in FIGS. 1-5).

The threaded collar 134 includes a body made of generally rigid material such as, but not limited to metal, plastic, ceramic, composite material, or combinations thereof. The body of the threaded collar 134 has a threaded opening extending there-through. The threaded opening has a thread pattern that matches (for threading engagement) with the thread pattern of the drive screw 132. The threaded collar 134 is threaded onto the drive screw 132.

The threaded collar 134 is connected to one or more struts (e.g., the struts 136 and 137) and is held from rotating about the axis $A_d$ (with the drive screw 132) by the one or more struts. In this manner, the threaded collar 134 may be driven along the drive screw 132 in a linear direction of the axis $A_d$, as the drive screw 132 is rotated about the axis $A_d$. The threaded collar 134 may be driven in a first linear direction of the axis $A_d$, as the drive screw 132 is rotated in a first direction (e.g., clockwise) about the axis $A_d$, and may be driven in a second linear direction (opposite to the first linear direction) of the axis $A_d$, as the drive screw 132 is rotated in a second direction (e.g., counterclockwise) about the axis $A_d$.

In the example in FIGS. 1-5, the struts 136 and 137 are connected to the threaded collar 134, at respectively opposite sides of the threaded collar 134 with respect to the axis $A_d$. Each of the struts 136 and 137 is connected to the threaded collar 134, via a first hinge or pivotal joint 133. The first hinge or pivotal joint 133 allows each strut 136 and 137 to pivot about a first joint axis $A_{j1}$. The first joint axis $A_{j1}$ is transverse to (e.g., perpendicular to) the axis $A_d$ of the drive screw 132. The first joint axis Ai may also be transverse to (e.g., perpendicular or oblique to) the axis A of the heat sink member 102.

Each of the struts 136 and 137 is connected to the heat sink member 102, through a second hinge or pivotal joint 135. The second hinge or pivotal joint 135 allows each strut 136 and 137 to pivot about a second joint axis $A_{j2}$. The second joint axis $A_{j2}$ is transverse to (e.g., perpendicular to) the axis $A_d$ of the drive screw 132 and may be parallel to the first joint axis Ai. The second joint axis $A_{j2}$ may also be transverse to (e.g., perpendicular or oblique to) the axis A of the heat sink member 102.

The second hinge or pivotal joint 135 may be connected to the heat sink member (directly or through one or more other components) or may be formed as part of the heat sink member 102. In the example in FIGS. 1-5, the second hinge or pivotal joint 135 is connected to the end cap 116 that is on and connected to one end of the heat sink member 102 (i.e., the end opposite to the surface 102*b* on which the light source 108 is mounted). In other examples, the second hinge or pivotal joint 135 may be provided on a central portion of the heat sink member 102 (located between the two ends), or on a further component extending from the heat sink member 102.

Each strut has a lengthwise dimension that extends at least between the first pivotal joint 133 and the second hinge or pivotal joint 135. Each of the struts 136 and 137 may be made of any suitable generally rigid material such as, but not limited to metal, plastic, ceramic, composite material, or combinations thereof. The struts 136 and 137 couple the threaded collar 134 to the heat sink member 102, and transfer the linear motion (and position) of the threaded collar 134 along the drive screw 132, to a tilt or pivot motion (and position) of the heat sink member 102 about the first adjustment axis $A_f$ relative to the mounting housing 112, 112'.

Each of the struts 136 and 137 is coupled to the heat sink member 102 through the second hinge or pivotal joint 135. In the example in FIGS. 1-5, the second hinge or pivotal joint 135 may be attached to or part of the end cap 116 on the heat sink member. Thus, the second hinge or pivotal joint 135 may be located at or adjacent to a second end of the heat sink member 102, opposite to the first end from which the flanges 121 and 122 extend. In other examples, the second hinge or pivotal joint 135 may be located at any other suitable location on the heat sink member 102, including a central location located between the first and second ends of the heat sink member 102.

As shown in FIGS. 1-5, the heat sink member 102 may have slot-shaped grooves on a side facing the struts 136 and 137, in which at least a portion of each strut 136 and 137 is received. As the angle of the axis A of the heat sink member 102 moves toward the 0° position (a vertical orientation, as shown in FIG. 1-5), a greater amount of the length of each strut 136 and 137 is received in the grooves 102*b* on the heat sink member 102. In certain examples, when the heat sink member is in the 0° position (vertical orientation in FIG. 5), the length of each strut 136 and 137 is received in the grooves 102*b*. Accordingly, the width of the lighting device assembly 100 at the heat sink member 102 may be minimized (or the width of the heat sink member 102 may be maximized), by allowing the struts 136 and 137 to be received within the grooves 102*b*.

The drive mechanism 130, including the drive screw 132, the threaded collar 134, the one or more struts 136 and 137, and the hinge or pivotal joints 133 and 135, may be operated to selectively drive or move the heat sink member 102, to change and adjust the direction or angle of the axis A of the heat sink member 102 about the first adjustment axis $A_f$. Accordingly, the drive mechanism 130 may be operated to selectively change or adjust the angle of the direction of light emitted from the light source 108 affixed to the heat sink member 102 about the first adjustment axis $A_f$.

In certain examples, the radial direction of the light source 108 may be selectively changed or adjusted by moving the heat sink member 102 around the second adjustment axis $A_p$ (the axis of rotation of the rotary base plate 113) to any of a plurality of possible rotational positions or orientations relative to that axis. In the examples of FIGS. 1-5, the base plate 113 is supported for rotational movement about the second adjustment axis $A_p$ by a rotary support structure 150, to selectively change or adjust the rotary orientation of the base plate 113 (and of other components supported by the base plate 113, including the drive mechanism 130 and the heat sink member 102) about that axis. Accordingly, the position of the heat sink member 102 may be rotated to any selectable position around the second adjustment axis $A_p$, by rotating the base plate 113 on the rotary support structure 150.

In certain examples, the second adjustment axis $A_p$ is equivalent to the axis A of the heat sink member 102, when the heat sink member 102 is oriented in a 0° position (a vertical orientation, as shown in FIGS. 2 and 3). By rotating the base plate 113 about the second adjustment axis $A_p$, the rotational position of the heat sink member 102 around (relative to) the axis $A_p$ may be changed and adjusted.

Accordingly, the drive mechanism 130 and rotational base plate 113, together, allow for both the angle and the rotational position of the heat sink member 102 to be changed and adjusted relative to the first and second adjustment axes $A_f$ and $A_p$.

The base plate 113 may be supported on the mounting housing 112, 112' (or other mounting structure) by any suitable rotary support structure 150 that allows the base plate 113 to rotate about the second adjustment axis $A_p$ relative to the mounting housing (or other mounting structure). The rotary support structure 150 may be secured to or part of the base plate 113 or of the mounting housing 112, 112' (or other suitable mounting structure). In particular examples, the rotary support structure 150 is configured to attach and retain the base plate 113 on the support structure 112, 112' for rotary motion about the axis $A_p$ relative to the support structure 112, 112' (for example, with the application of manual rotational force), and inhibit significant movement of the base plate 113 in a linear direction of the axis $A_p$ relative to the support structure 112, 112'. In some examples, the base plate 113 is configured to selectively attach to the rotary support structure 150 and to be selectively detached from the rotary support structure 150 by manual force on the base plate 113.

Certain examples of a releasable connection mechanism is described herein, wherein the rotary support structure 150 includes at least one annular ring member (first and second annular ring members 152 and 154 shown in FIG. 3) that are supported on the support structure 112, 112' for rotary motion about the axis $A_p$ relative to the support structure 112, 112' and that may be selectively attached to the base plate 113. The annular ring member(s) 152, 154 are rotatably secured to the support structure 112, 112' in any suitable manner.

In certain examples, the annular ring member(s) 152, 154 are arranged in (and rotatable within) an annular channel on the inner surface of the support structure 112, 112'. In certain examples, the annular channel is formed between an inwardly extending lip 112*a*, 112'*a* that extends around the circular opening on one end of the support structure 112, 112' (the upper end in FIG. 3), and a further ring member 153 that is securely connected to the support structure 112, 112', below the lip 112'*a*. In certain examples, the further annular ring member 153 is a made of a material with a natural spring force that expands the diameter of the ring member from a partially compressed state, to tightly secure the ring member 153 to the support structure 112, 112'. In other examples, the annular ring member 153 may be secured to the support structure by one or more fasteners such as, but not limited to screws, bolts or other threaded fasteners, clips, friction fitting, adhesives or combinations thereof. In yet other examples, other suitable rotary support structures may be employed, to support the base plate 113 for rotary movement about the axis $A_p$ relative to the support structure 112, 112'.

In particular examples, a peripheral edge portion of the base plate 113 is configured to be selectively received and connected with one or both of the annular ring member(s) 152, 154 for rotation with the annular ring member(s) 152, 154 around the axis $A_p$ relative to the mounting housing 112, 112', and inhibit movement of the base plate 113 in a linear direction of the axis $A_p$ relative to the mounting housing 112, 112'.

In certain examples, one or both of the annular ring member(s) 152, 154 may include one or more adjustment sections that allow the diameter of the annular ring member (including its inner and outer diameter) to be selectively changed or adjusted. In those examples, the diameter of the annular ring member(s) may be selectively adjusted during manufacture or assembly of the lighting device assembly. Such adjustment capabilities may help to simply a process of assembling the annular rail 152 and the base plate 113 on the mounting housing 112, 112' (or other mounting structure), and/or allow the annular rail 152 to accommodate openings of multiple different sizes in different mounting housings 112, 112' (or other mounting structures), such as for lighting device assemblies of different sizes or styles.

The base plate 113 has a first surface (e.g., the upward-facing surface in FIGS. 1-5, 8 and 9) and a second surface (e.g., the downward-facing surface in FIGS. 1-5, 8 and 9). The base plate 113 is supported by the annular rail 152 of the rotary support structure 150, with the first surface of the base plate 113 facing the heat sink member 102 and the heat sink support structure 120. In the example of FIGS. 1-5, 8 and 9, the rotary mount 140 for the drive screw 132 is mounted on the first surface of the base plate 113. The drive screw 132 extends outward (e.g., vertically upward in the orientation of FIGS. 1-5, 8 and 9) from the first surface of the base plate 113, for example, with the axis $A_d$ perpendicular to the plane of the first surface of the base plate 113 and parallel to the rotary axis $A_p$ of the base plate 113.

In certain examples, the flanges 123 and 124 extend from the first surface in a first direction of the axis $A_p$ (in the upward direction in FIGS. 1-5, 8 and 9). In certain examples, the flanges 123 and 124 may be attached to the base plate 113. In other examples flanges 123 and 124 may be formed with the rest of the base plate 113 (e.g., formed as tabs that are bent upward to form upward extending flanges 123 and 124, relative to the orientation in FIGS. 1-5, 8 and 9).

Figure 10:
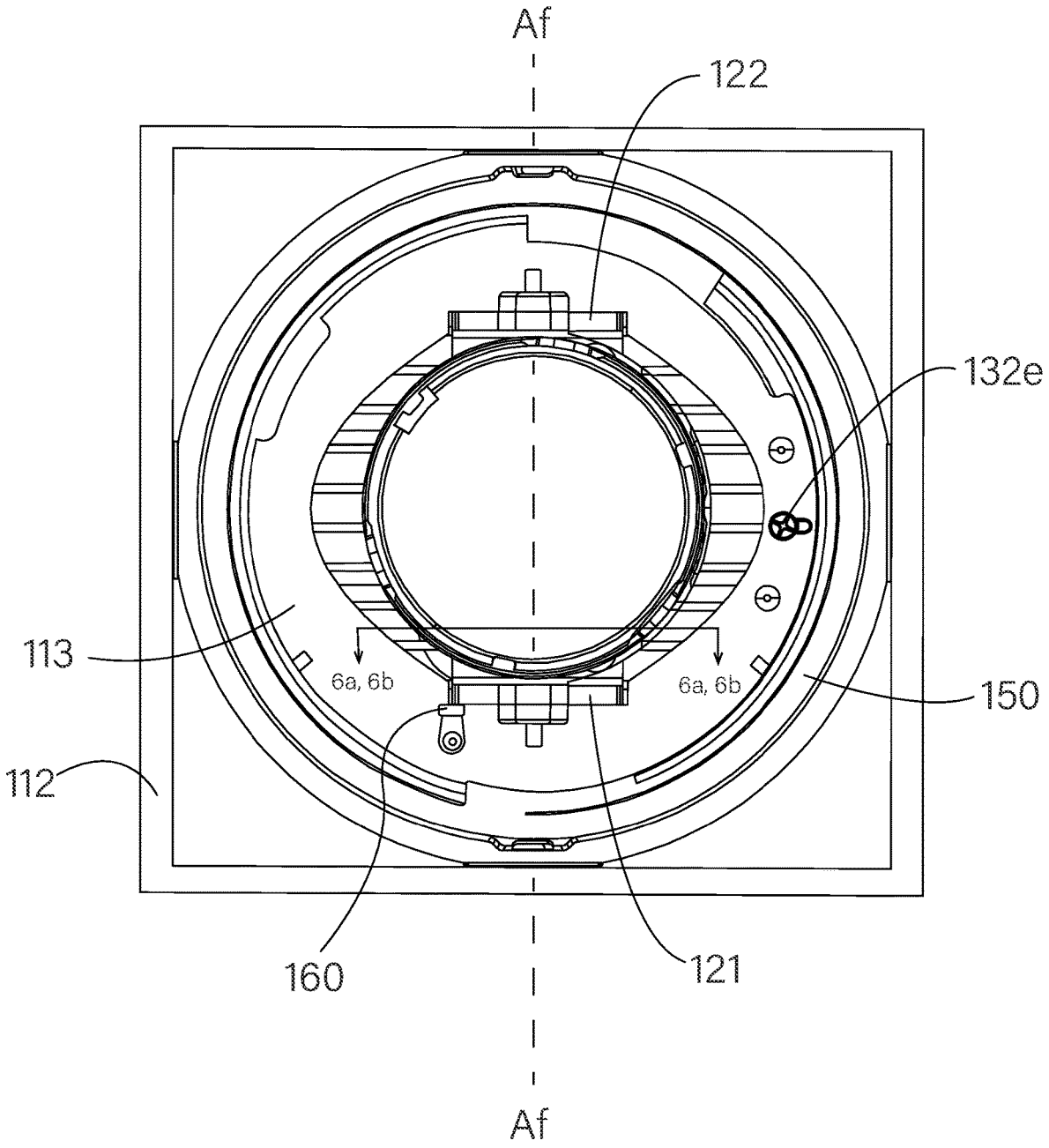
FIG. 10 is a bottom view of a lighting device assembly with a mounting housing of FIG. 1.

The base plate 113 may have an opening through which an end portion 132*e* of the drive screw 132 extends, to expose an end portion 132*e* of the drive screw 132 through the open side of the mounting housing 112, 112' (as shown in FIG. 10). The exposed end portion 132*e* of the drive screw 132 is at the opposite end of the drive screw relative to the head portion 132*d* of the drive screw 132. The exposed end portion 132*e* of the drive screw 132 (and the opening in the base plate 113 through which the end portion 132*e* extends) is provided at a location on the base plate 113 that is visible or accessible (or both) through the open end of the mounting housing 112, 112' (or other mounting structure), when the mounting housing 112, 112' (or other mounting structure) is mounted in a ceiling, wall, outer housing or other object.

The exposed end portion 132*e* of the drive screw 132 may include a shaped surface or head that is configured to be engaged by a tool or by a user's hand, to selectively rotate the drive screw 132 about the axis $A_d$. For example, the shaped surface or head of the exposed end 132*e* may have a slot-shaped recess (for engagement by a flat-head screwdriver), a cross or star-shaped recess (for engagement by a Philips screwdriver), a hexagonal or other polygonal shaped recess (for engagement by an Allen wrench, star wrench or other tool), or hexagonal or other polygonal shaped head (for engagement by a socket wrench, crescent wrench or other tool), a wheel shape (for gripping by a user's finger and thumb), or other suitable shapes for engagement and rotation by a tool or a user's hand. As described herein, rotation of the drive screw 132 drives the threaded collar 134 in a linear direction of the axis of the drive screw 132 to adjust the angle of the axis A of the heat sink member 102.

In certain examples, a tilt indicator 160 is attached to or formed on the base plate 113. In the example in FIGS. 6*a*, 6*b* and 10, the tilt indicator 160 includes a bracket that is marked with a row of a plurality of parallel or radial lines (or other markings) to indicate a corresponding plurality of different angles or angular positions of the axis A of the heat sink member 102 relative to the axis $A_p$ or other suitable reference line or angle.

The tilt indicator 160 bracket is arranged on the base plate 113, at a location at which the bracket is partially overlapped by one of the flanges 121 or 122, as the heat sink member 102 moves through its range of pivoting or tilting motion and positions. The amount of overlap of the flange 121 or 122 over the tilt indicator 160 bracket changes with (is dependent on) the angular position or orientation of the axis A of the heat sink member 102 about to the second adjustment axis $A_p$ or other reference line or angle. Accordingly, the plurality of line (or other) markings on the bracket of the tilt indicator 160 are located to correspond to an associated plurality of overlap positions of an edge of the flange 121 or 122, at specific tilt angles of the axis A of the heat sink member 102, as shown in FIGS. 6*a* and 6*b*. In other examples, the tilt indicator 160 may include line (or other) markings formed directly on the base plate 113. In particular examples, the tilt indicator 160 (including the line or other markings) are located in a position to be visible through the open end of the mounting housing 112, 112' (or other mounting structure), when the mounting housing 112, 112' (or other mounting structure) is mounted in a ceiling, wall, outer housing or other object.

In particular examples, the lighting device assembly 100, 100' is configured to be mounted in an enclosed environment, such as, but not limited to, a recess of a ceiling, wall or other object. In some examples, the mounting housing 112, 112' (or other mounting structure) of the lighting device assembly 100, 100' may include clips, brackets or other mounting mechanisms 117 to secure the mounting housing 112, 112' to a ceiling or wall panel, or other structure. When mounted in the ceiling, wall or other object, the open side (bottom side in FIGS. 1-5 and 7-9) of the mounting housing 112, 112' is aligned with and exposed through an opening in the ceiling, wall or other object.

Figure 11A:
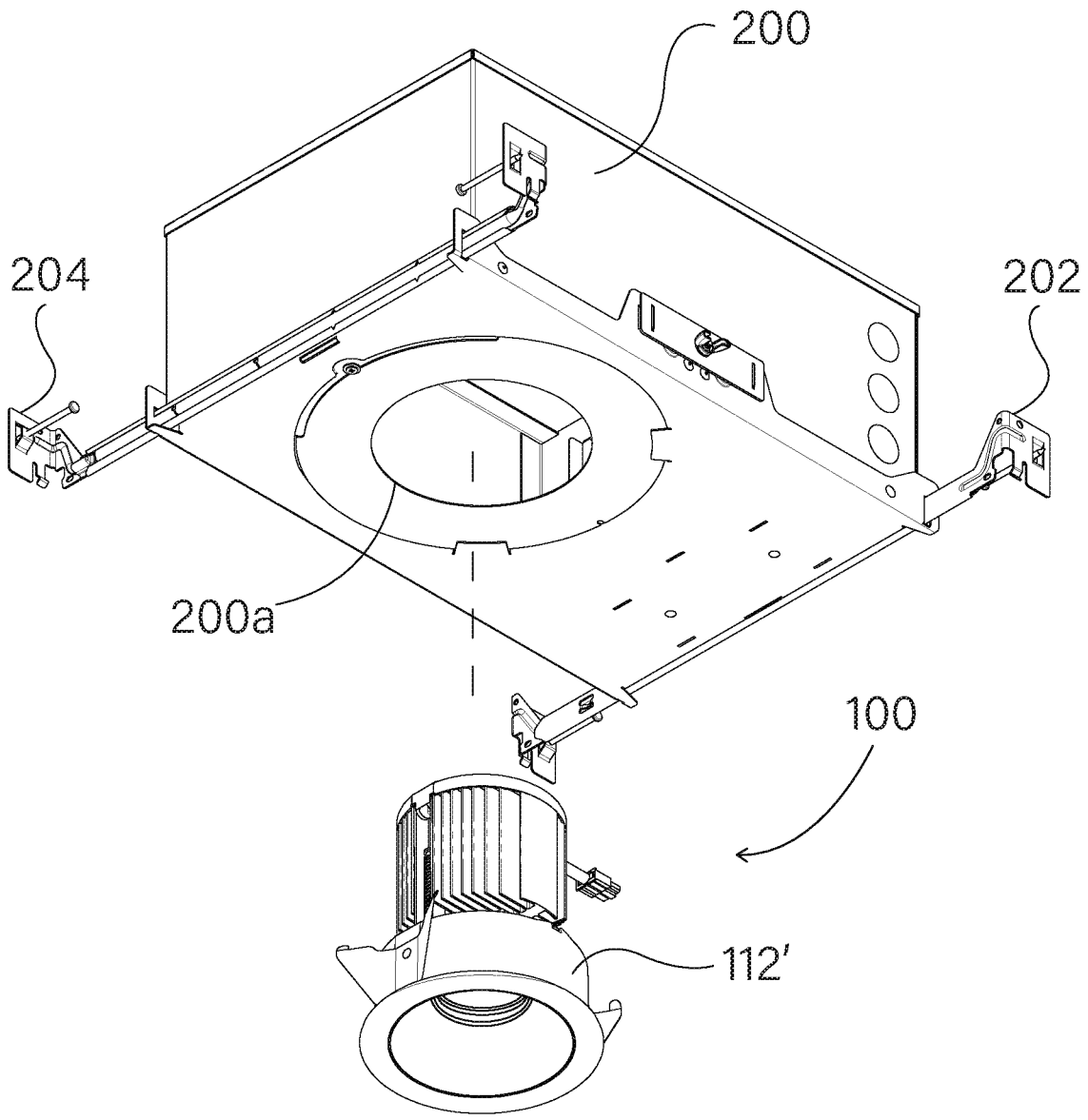
FIGS. 11*a* and 11*b* are partial exploded views of two systems, each having a lighting device assembly with a mounting housing of FIGS. 2 and 3, and a further outer housing.
Figure 11B:
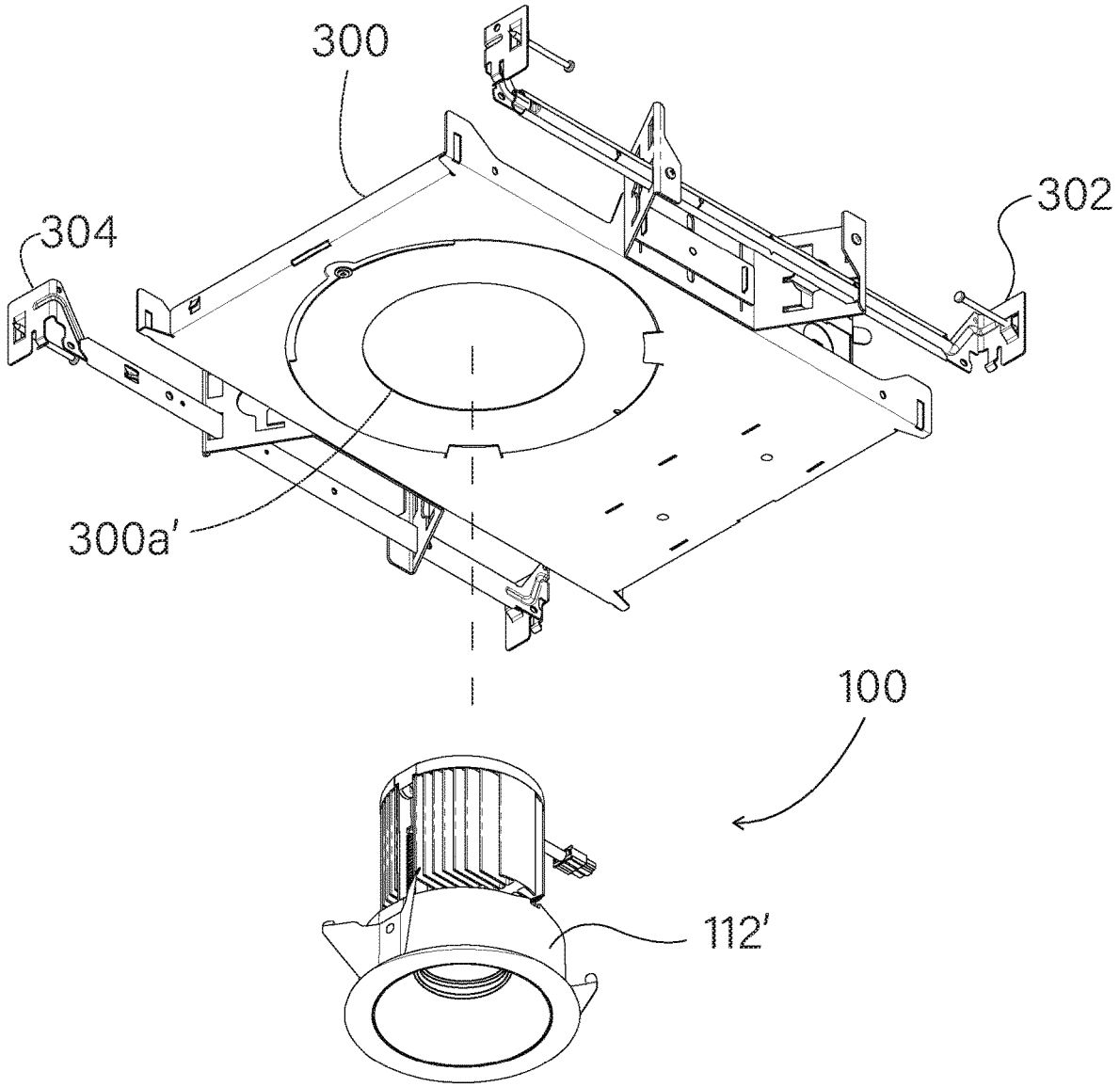

In some examples as shown in FIGS. 11*a* and 11*b*, the lighting device assembly 100 is configured to be mounted in the interior of a housing 200 or 300 (e.g., an outer housing), where that housing is configured to be mounted in a recess of a ceiling, wall or other structure. In certain examples, the outer housing 200 or 300 may include an opening 200*a* or 300*a* configured to be aligned with a corresponding opening in a ceiling, wall or other structure, when the outer housing is located within a plenum space or other space within a ceiling, wall or other structure. When installed, the open side (bottom side in FIGS. 1-5, and 8-10) of the mounting housing 112, 112' (or other mounting structure) is aligned with and exposed through the aligned openings 200*a*, 300*a* in the outer housing 200, 300 and in the ceiling, wall or other structure.

In certain examples, the enclosure structure of the further housing 200 may be fully enclosed, except for the opening 200*a* on one side (the bottom side in FIG. 11*a*) through which the mounting housing 112, 112' and the lighting device assembly 100 is received. In other examples, one or more sides of the further housing 200 (such as, but not limited to the top side in FIG. 11*a*) may be left open.

The further housing 300 includes a plate-shaped structure having the opening 300*a* through which the lighting device assembly 100 is received. The further housing 200 may include one or more brackets 202 and 204 (two shown in FIG. 11*a*), and the further housing 300 may include one or more brackets 302 and 304 (two shown in FIG. 11*b*). The brackets 202, 204, 302 and 304 may be configured to secure or attach the further housing 200 or 300 to one or more beams, rafters, or other structure in a ceiling, wall or other object in which the further housing 200 or 300 is to be mounted. In particular examples, each of the brackets 202, 204, 302 and 304 may have one or more (or plural) openings or slots for receiving suitable fasteners, such as, but not limited to screws, bolts, nails or the like, for securing the bracket to one or more beams, rafters, or other structure.

In certain examples, each of the brackets 202, 204, 302 and 304 is adjustable in length. For example, each bracket 202, 204, 302 and 304 may have one or more telescoping or slidable components that telescope or slide to selectively expand or contract the length of the bracket, at least between a minimum and a maximum length defined by the bracket components. The adjustability of the lengths of the brackets can help to simplify installation processes for mounting the further housing 200 or 300 in a ceiling, wall or other object.

In particular examples, the further housing 200 or 300 may be mounted and secured within a plenum, duct or attic space (or the like) in a ceiling, wall or other object, with the opening 200*a* or 300*a* aligned with a corresponding opening in the ceiling, wall or other object. The brackets 202, 204, 302 and 304 may be adjusted in length, to accommodate the space and secure the further housing 200 or 300 in the ceiling, wall or other object. Once each bracket 202, 204, 302 and 304 is mounted, then the lighting device assembly 100, including the mounting housing 112, 112' may be inserted into the opening 200*a* or 300*a* of the further housing 200 or 300, and secured to the further housing by one or more spring clips 117 or other clips, brackets or other mounting mechanisms on the mounting housing 112, 112'.

Once the lighting device assembly 100, 100' is mounted in the mounting housing 112, 112', the rotational position of the heat sink member 102 and the angle of the axis A of the heat sink member 102 may be adjusted, to adjust the angle and radial direction of the light emitted from the light source 108. As discussed herein, the base plate 113 or the optic member 104 may be manually rotated about the axis $A_p$, to select a desired radial direction of light emission from the lighting device assembly 100, 100'. In addition, the angle of light emitted from a light source of the lighting device assembly is selectively adjusted by accessing the end portion 132*a* of the drive screw 132 and rotating the drive screw 132. The tilt indicator 160 may be observed during or after the angle adjustment, as desired.

In yet other examples, the lighting device assembly 100, 100' (with or without an outer housing) may be configured to be surface mounted on a surface of a ceiling, wall or other object, or mounted on a pedestal or other support structure extending from a ceiling, wall, or other object. As described herein, the lighting device assembly 100, 100' is further configured such that the end portion 132*a* of the drive screw 132 and the tilt indicator 160 are in view or accessible (or both) through the open side of the mounting housing 112, 112' (or other mounting structure), when and after the lighting device assembly 100 is mounted. In certain examples, a trim member or the like may be placed over and cover portions of one or more (or each) of the mounting housing 112, 112', base plate 113, drive screw end portion 132*a*, or tilt indicator 160, for example, after a pivoted or tilted position of the heat sink member axis A is adjusted or selected.

When mounted in or on a ceiling, wall or other object, the lighting device assembly 100, 100' may be selectively adjusted to change or adjust the direction of light emitted from the light source 108 of the lighting device assembly. More specifically, the base plate 113 or the optic 104 (or a portion of the heat sink member 102) is accessed through the open side (bottom side in FIGS. 1-5 and 8-11*b*) of the mounting housing 112, 112' (or other mounting structure) and is manually rotated about the axis $A_p$ of rotation of the base plate 113. The force to manually rotate the base plate 113 about the axis $A_p$ may be applied by a user's hand. In particular examples, the annular rail 152 in which the base plate 113 rotates is configured to provide a suitable amount of resistance or tension against the rotational motion of the base plate 113 to maintain the rotated position and adjustment of the base plate 113 after removal of the manual force. However, the amount of resistance or tension may be sufficiently low so as to be overcome by a reasonable amount of manual force. Rotation of the base plate 113 or the optic member 104 rotates the heat sink member 102 supported on the base plate 113 about the second adjustment axis $A_p$, to selectively adjust the radial direction of light emitted from the light source 108 and optic member 104 on the heat sink 102. Accordingly, the base plate or the optic member 104 are rotated about the second adjustment axis $A_p$, to select a desired radial direction of light emission from the lighting device assembly 100, 100'.

In addition, the angle of light emitted from a light source of the lighting device assembly is selectively adjustable about the first adjustment axis $A_f$. More specifically, the end portion 132*a* of the drive screw 132 is accessed through the open side (bottom side in FIGS. 1-5 and 8-11*b*) of the mounting housing 112, 112' (or other mounting structure) and is rotated manually (by hand or with a tool). As described herein, the threaded portion 132*a* of the drive screw operates to drive the threaded collar 134 in the linear direction of the drive screw axis, as the drive screw 132 is rotated.

The linear movement of the collar 134 is transferred, by the struts 136 and 137, to pivotal movement of the heat sink member 102, to selectively adjust the direction or angle of the axis A of the heat sink member 102 about the first adjustment axis $A_f$. By selectively changing or adjusting the direction or angle of the axis A, the direction of the light emission from the lighting device assembly 100, 100' is selectively changed and adjusted. The tilt indicator 160 may be viewed, during or after the angle adjustment is carried out. After the rotary and angled orientations of the heat sink member 102 have been adjusted and selected (to adjust and select the rotary and angled orientation of the light emission direction of the light source 108 and optic 104), a trim member or the like may be placed over and cover portions of the mounting housing 112, 112', base plate 113, drive screw end portion 132*a*, and tilt indicator 160.

In certain examples, the drive thread pattern on the threaded portion 132*a* is configured to provide a smooth, but efficient operation of driving the threaded collar 134. For example, the number of thread starts (or continuous threads) in the thread pattern and the pitch of the thread pattern (or the spacing of the thread rounds per unit length) can affect the operation feel and efficiency of the drive screw.

The pitch of the thread pattern can determine or affect the number of turns of the drive screw 132 needed to move the threaded collar 134 in the linear direction by a given unit length. If the pitch is too great, the drive screw may require a greater-than-desired number of turns to move the threaded collar 134 a given unit length (or a distance sufficient to adjust the angle of the heat sink member 102 a desired amount. If the pitch is too small, then the rotating operation of the drive screw may not feel smooth to a user, or the drive screw thread pattern may not provide a sufficiently strong force to retain the threaded collar in a linear position along its length. However, the use of multiple thread starts (multiple continuous, interleaved threads) in the thread pattern, each having the same pitch, can improve the feeling of a smooth operation and increase the strength of the retention force to hold the threaded collar in an adjusted linear position along the length of the drive screw axis.

Accordingly, in particular examples, the threaded portion 132*a* of the drive screw 132 has a thread pattern that includes multiple thread starts (multiple continuous, interleaved threads) and a thread pitch, where the number of thread starts and the pitch is selected for a desired operation feel or efficiency (or both). In certain light fixture assembly examples, a preferred number of thread starts is within the range of and including 2-6, or more preferably within the range of and including 3-5, or may be 4. In addition, in certain examples, a preferred thread pitch is in the range of and including 10-30 threads per inch (TPI), or may be 20 TPI. The threaded portion 132*a* of the drive screw 132 may have any suitable diameter including, but not limited to a diameter in the range of and including 0.125-0.5 inch, or may be about 0.25 inch. However, other examples may include other suitable combinations and values of thread starts, pitches, and diameters for the threaded portion 132*a* of the drive screw 132.

Wall Wash Optic

Figure 12:
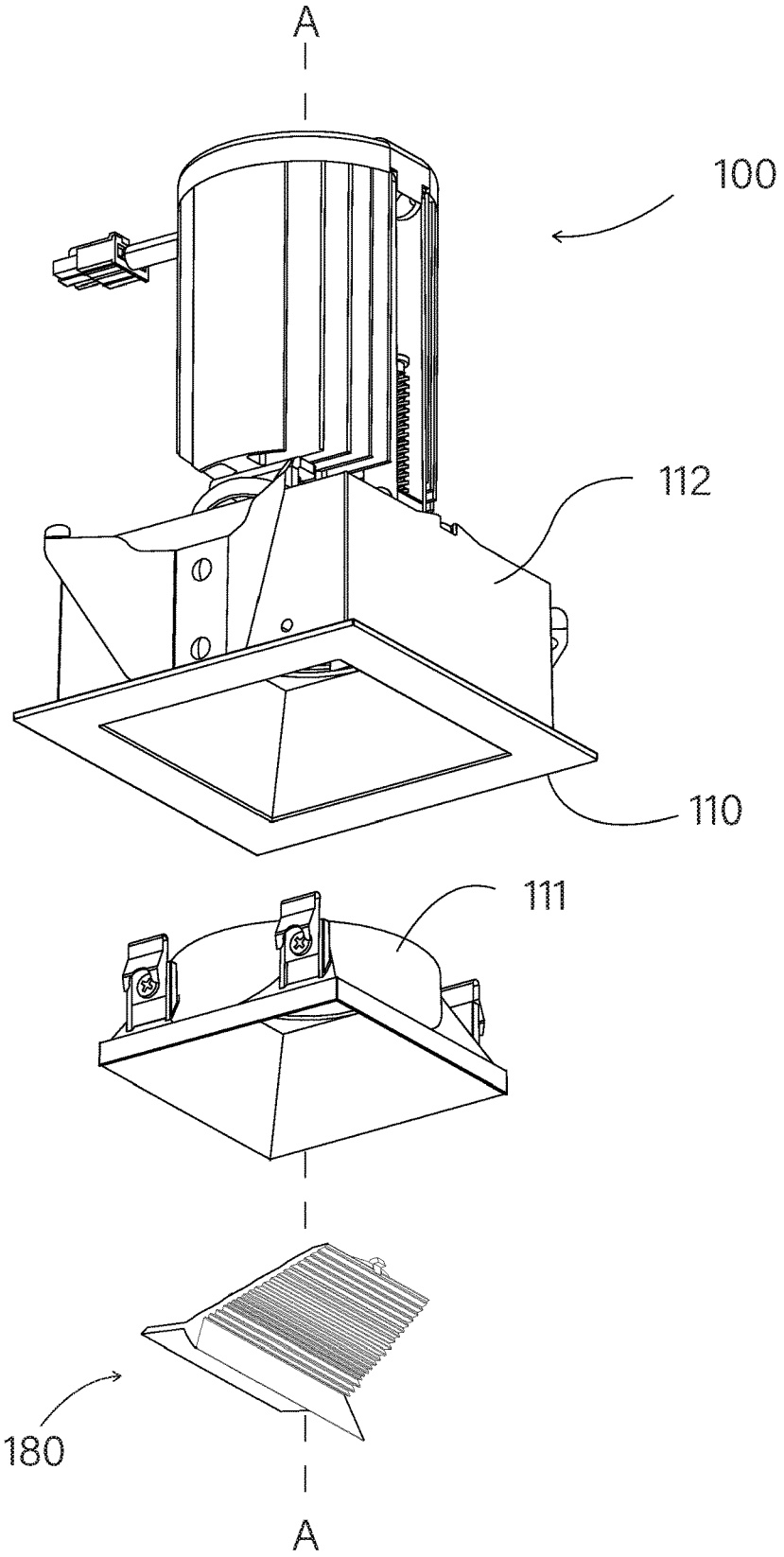
FIG. 12 is a partial exploded, perspective view of a system having a lighting device assembly of FIG. 1 and a further optic.
Figure 13:
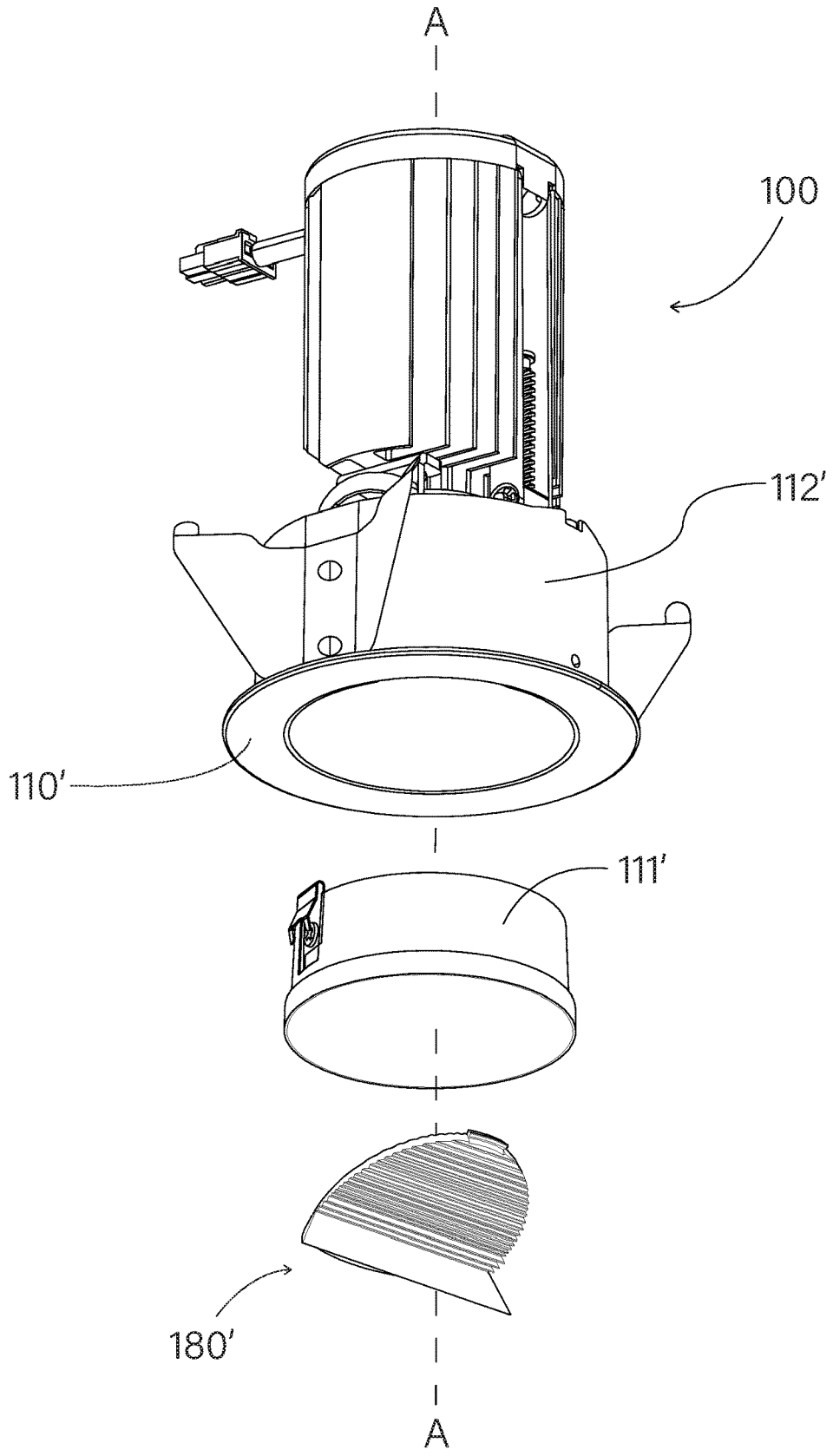
FIG. 13 is a partial exploded, perspective view of a system having an assembled lighting device assembly of FIGS. 2 and 3, and a further optic.
Figure 14:
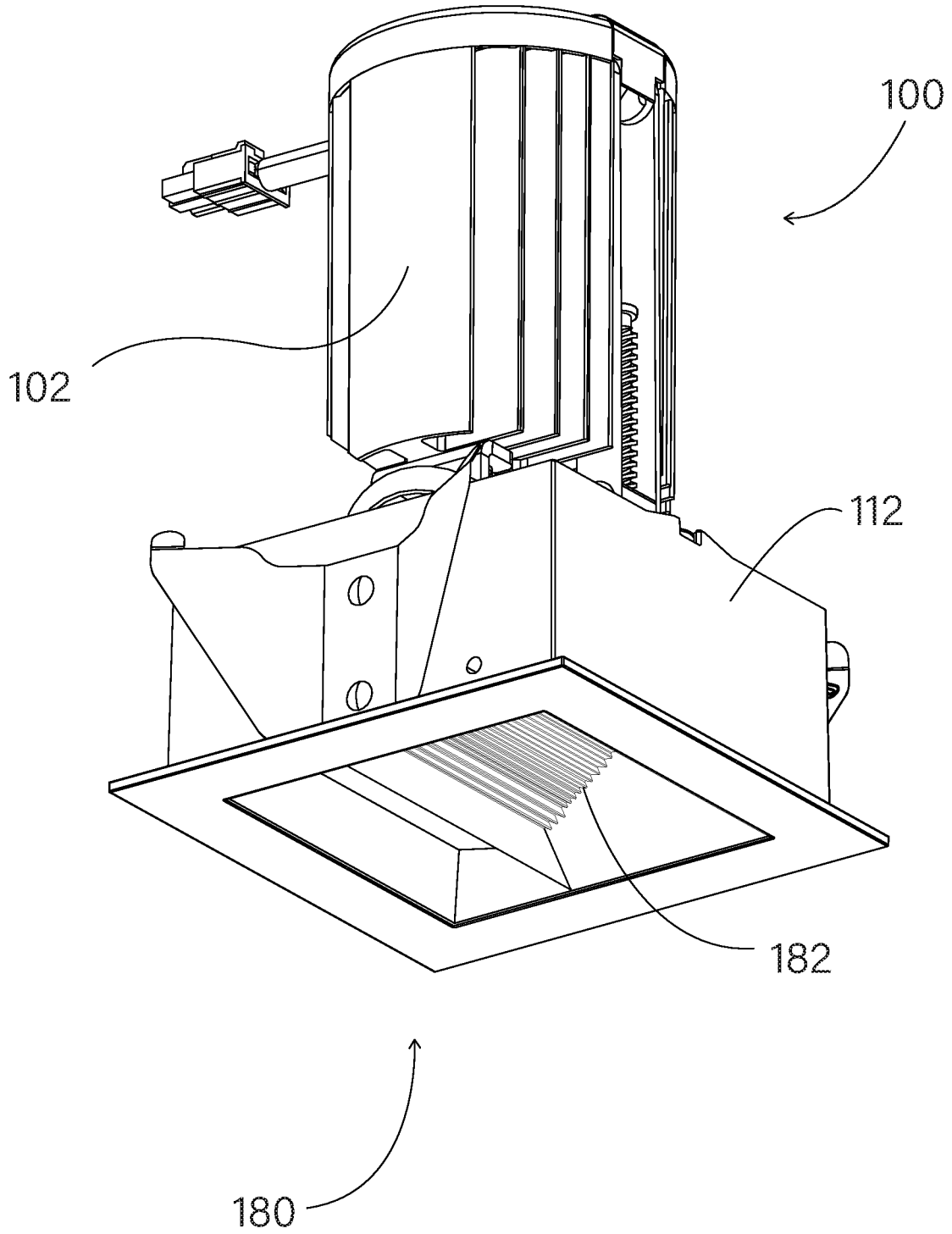
FIG. 14 is a perspective view of an assembled system of FIG. 12.
Figure 15:
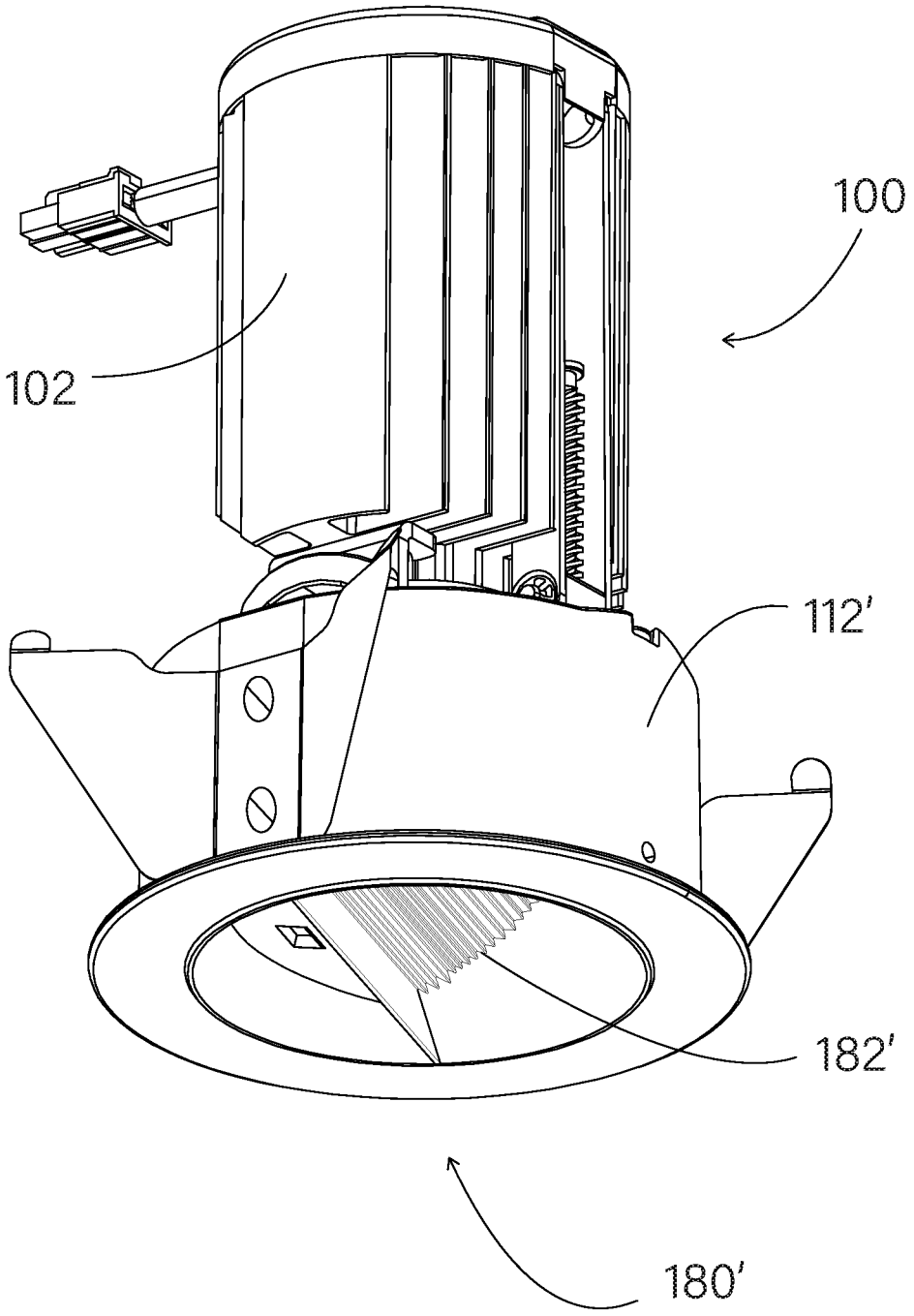
FIG. 15 is a perspective view of an assembled system of FIG. 13.
Figure 20:
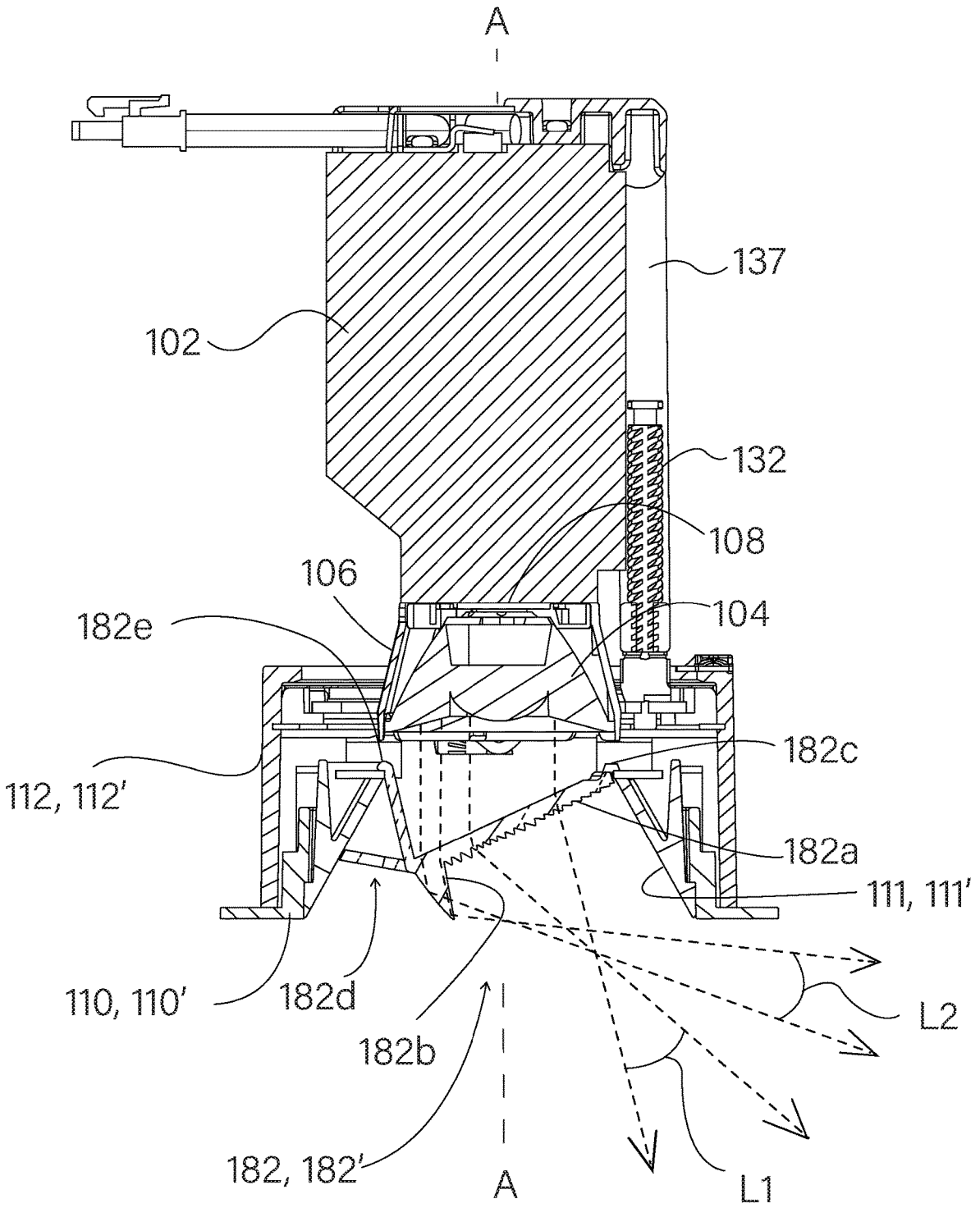
FIG. 20 is a cross-section view of an assembled system of FIG. 12 or of FIG. 13.

Any of the examples described herein may include a further optic member, in addition to (or as an alternative to) the optic member 104. An example of a further optic member 180 for a rectangular or cuboidal shaped mounting housing 112 is shown in FIGS. 12 and 14, and a further optic member 180' for a cylindrical shaped mounting housing 112' is shown in FIGS. 13 and 15. A cross-section view that can correspond to either mounting housing 112 or 112' is shown in FIG. 20. In particular examples, the further optic member 180, 180' is attached to and held by the trim member insert 111. A trim member insert 111 for a trim member 110 and mounting housing 112 having a round opening is shown in FIG. 12, and a similar trim member insert 111' for a trim member 110' and mounting housing 112' having a round opening is shown in FIG. 13. The trim member insert 111 or 111' is configured to be received into the opening of the trim member 110 or 110', and secured to the trim member 110 or 110' and the mounting housing 112 or 112' as described herein.

In the example shown in FIGS. 12 and 14, the annular body of the trim member insert 111 has an outside shape and dimension to fit within a rectangular or polygonal opening in the mounting housing 112. However, in the example in FIGS. 13 and 15, the annular body of the trim member insert 111' has an outside shape and dimension to fit within a round or circular opening in the mounting housing 112'. In certain examples, the inner surface of the annular body of the trim member insert 111' may taper from an open, narrower end (the upper end in FIGS. 12-15) to an open, wider end (the lower end in FIGS. 12-15). Some or all of the inner surface of the annular body of the trim member insert 111, 111' may be reflective, and may have a reflective coating or reflective surface treatment to reflect light emitted from the light source 108 and the first optic member 104.

The annular body of the trim member insert 111, 111' may be secured to the trim member 110, 110' or the mounting housing 112, 112' by any suitable connection mechanism such as, but not limited to a connection mechanism that allows the trim member insert 111, 111' to be selectively connected to and selectively disconnected from the trim member 110, 110' or the mounting housing 112, 112', for example, to easily add, remove, replace, clean or service the further optic member 180, 180', as desired. For example, as described herein, the outer surface of the annular body of the trim member insert 111, 111' may include one or more (or a plurality) of spring clips, other clips, fasteners, ridges, grooves or other features to help retain the annular body within the mounting housing 112, 112' (or to retain one or more seal members to inhibit passage of liquid).

In certain examples, the annular body of the trim member insert 111, 111' provides a friction fit or a snap fit with the trim member 110, 110' or the mounting housing 112, 112', sufficient to retain the annular body in the opening of the mounting housing 112, 112'. In particular examples, the retention force is sufficient to retain the annular body in the mounting housing 112, 112' (e.g. against gravity), but also allow the trim member insert 111, 111' to be selectively pulled out of its engagement in the mounting housing 112, 112' with application of a manual pulling force on the trim member insert 111, 111'. In some examples, a snap fit configuration may include one or more ribs (or other protrusions) or grooves (or other indentations) on the outer surface of the annular body of the trim member insert 111, 111', for engaging and mating with a corresponding one or more grooves (or other indentations) or ribs (or other protrusions) on the inner surface of the trim member 110, 110;' or the mounting housing 112, 112' adjacent the opening in the mounting housing when the annular body of the trim member insert 111, 111' is received in the opening of the open side of the mounting housing 112, 112'. In other examples, the annular body of the trim member insert 111, 111' may selectively connect to the mounting housing 112, 112' by other suitable connection mechanisms including, but not limited to a threading connection between threads (not shown) on the outer surface of the annular body and threads (not shown) on an inner surface on the trim member 110, 110' or the mounting housing 112, 112', adjacent the opening in the mounting housing.

Figure 16:
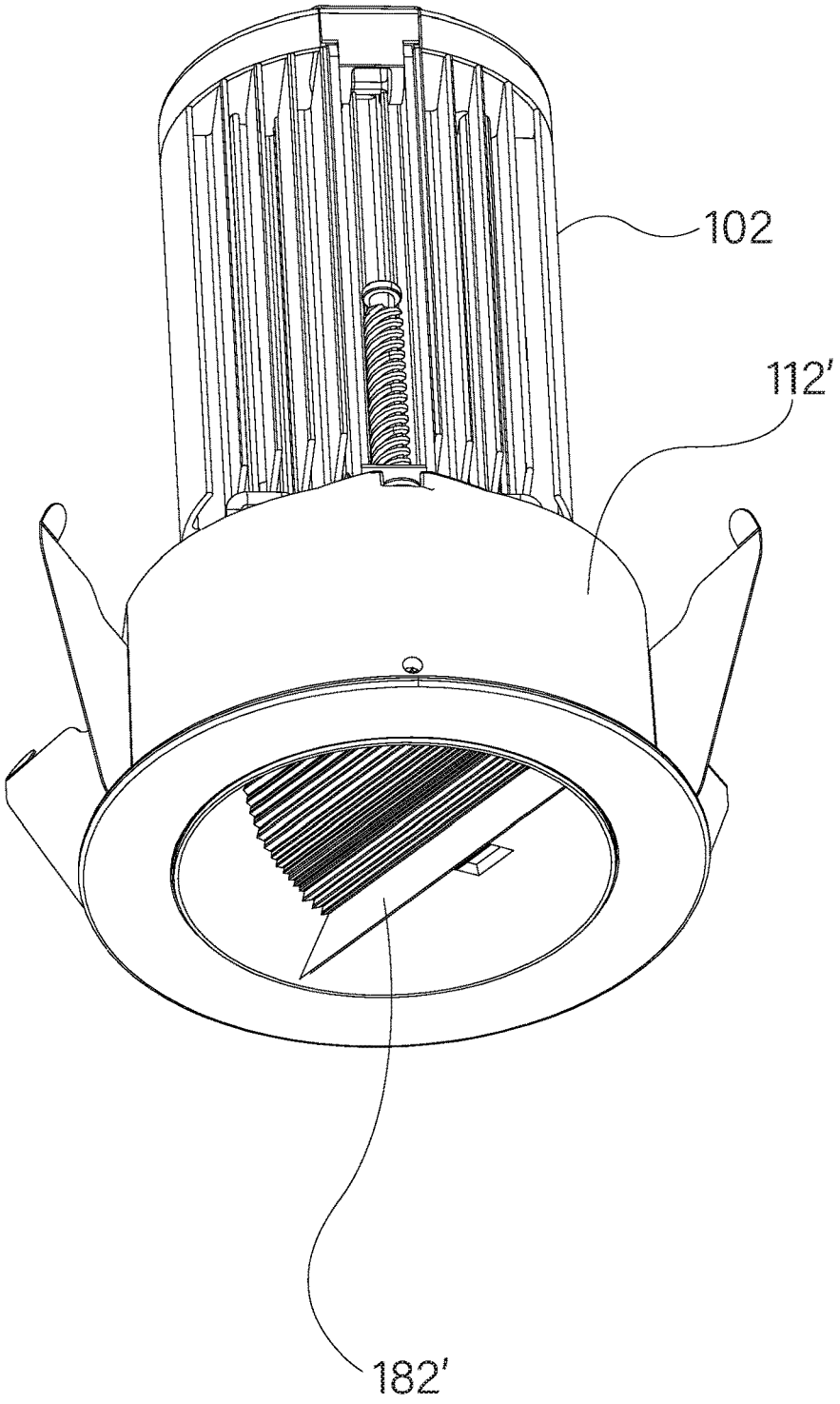
FIGS. 16 and 17 are perspective views of an assembled system of FIG. 13, with two different orientations of the further optic.
Figure 17:
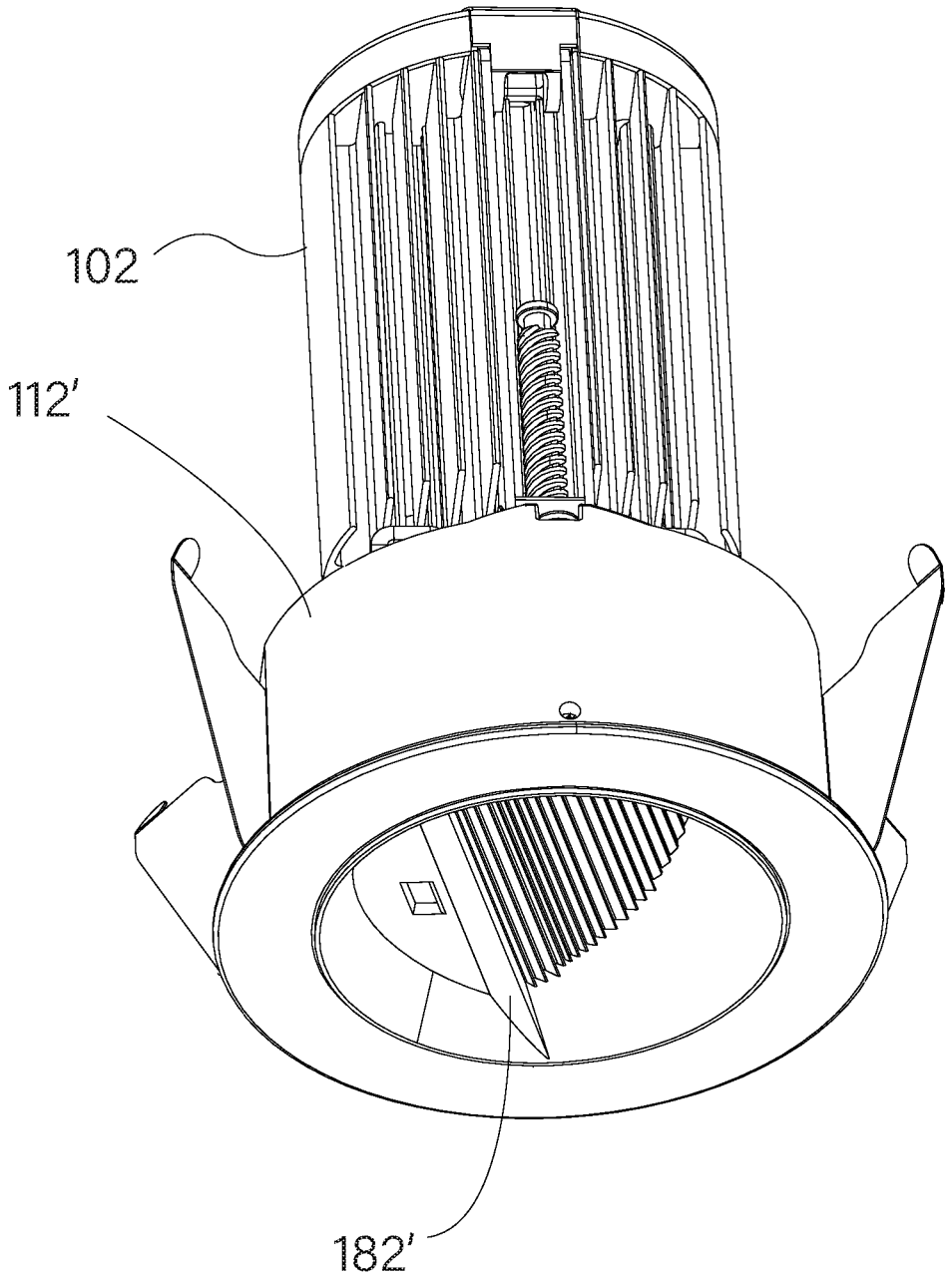

In particular examples, the annular body of the trim member insert has a cylindrical shape (such as the trim member insert 111' in FIGS. 13 and 15) and is configured to be manually rotatable around a central axis of the mounting housing 112' (which may correspond to the rotational axis $A_p$ of the plate 113), to rotate the further optic member 180' relative to the mounting housing 112'. Alternatively or in addition, the further optic member 180' is supported in the trim member insert 111' for manual rotation relative to the trim member insert 111' about the axis A. Accordingly, the position and direction of the further optic member 180' may be rotated and adjusted around the axis A. An example of a lighting device assembly 100 with a further optic member 180' in the mounting housing 112', in a first rotational orientation is shown in FIG. 16, while the same lighting device assembly 100 and mounting housing 112' is shown in FIG. 17 with the further optic member 180' in a second rotational orientation (rotated about 90 degrees around the axis A relative to the orientation in FIG. 16).

In certain examples, the further optic member 180' may include a protruding feature (such as, but not limited to the kicker feature 182'*b* described below) that can be gripped between a user's thumb and finger, while applying manual rotation force to rotate the further optic member 180' relative to the mounting housing 112' to an adjusted position. In particular examples, frictional resistance (or other resistance features) between the further optic member 180' and the mounting housing 112' maintains the further optic member 180' in its adjusted rotational orientation, once manual force is removed.

In further examples, the further optic member 180, having a rectangular shape, may be positioned within and secured to the annular body of the trim member insert 111, in any one of multiple (e.g., two or four) orientations. In such examples, the initial orientation of the second optic 180 may be changed by withdrawing the second optic 180 from the annular body of the trim member insert 111 (for example, by manually pulling the second optic 180 out of the trim member insert 111), rotating the second optic 180 either 90 degrees, 180 degrees or 270 degrees, and manually re-inserting the second optic 180 into the annular body of the trim member insert 111 to secure the second optic to the trim member insert 111 in a rotated orientation relative to its initial orientation. In certain examples, the second optic member 180, 180' is configured to direct light from the light source 108 and the first optic 104, in a direction that changes with changes in the rotation of second optic member 180, 180' relative to the mounting housing 112, 112'.

As discussed herein, n certain examples, a lighting device assembly 100 may be operable with any one of a plurality of different further optic members 180, 180' and mounting housings 112, 112', where any one of those optic members may be selected, received in and secured to any correspondingly shaped mounting housing 112, 112', to provide a wide variety of possible shapes and ornamental configurations that can employ the same type of lighting device assembly 100. In some examples, each different further optic member 180, 180' may provide a different pattern, degree of pattern spread, direction, color or other quality of light from the light source, relative to one or more (or each) other optic 182, 182' in the plurality of optic members.

In yet further examples, different primary optics 104 may be employed or replaced in the lighting device assembly 100 to provide different light characteristics, with or without the further optic member 180, 180'. For example, different primary optics 104 may provide different light pattern degrees that, when employed with a further optic member 180, 180' having a wall wash optic, can provide different wall lighting patterns.

Figure 18:
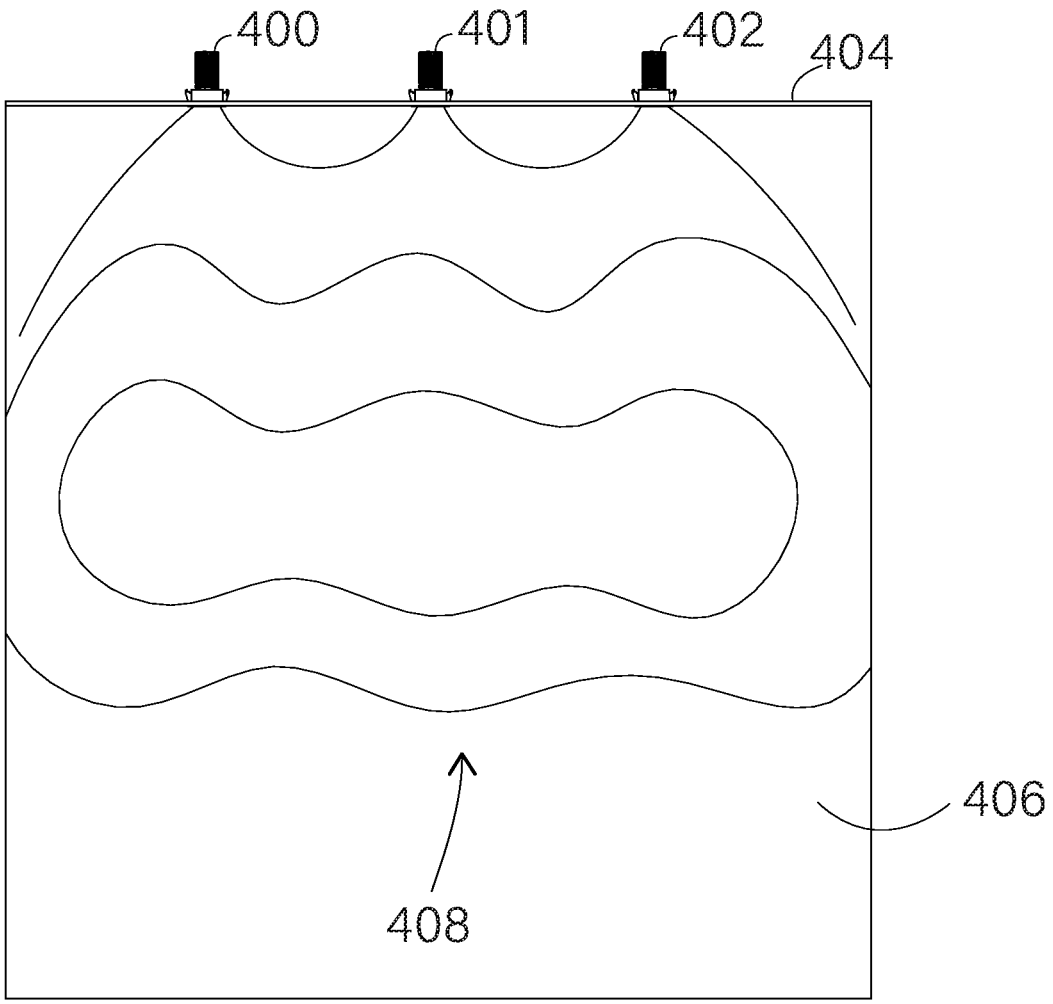
FIGS. 18 and 19 are schematic diagrams representing a light pattern formed on a wall, from a system having multiple lighting device assemblies of FIGS. 12-14.
Figure 19:
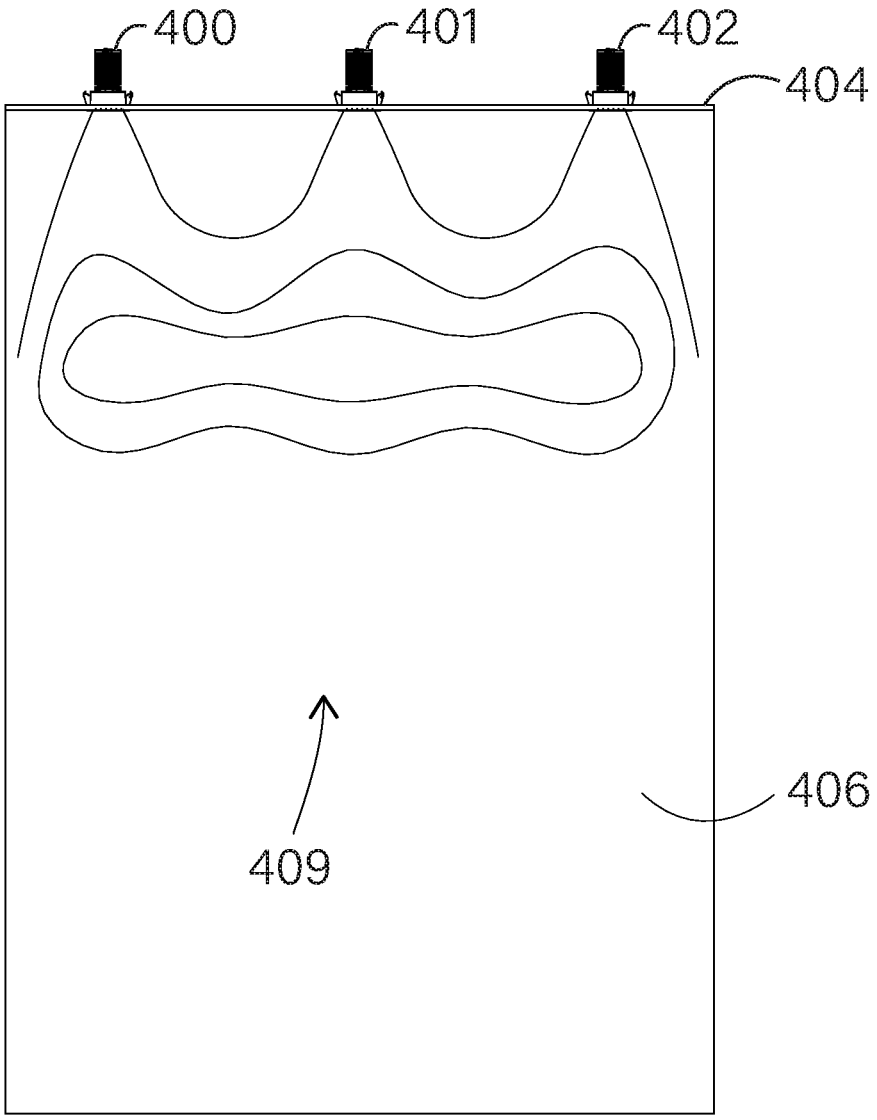

For example, FIG. 18 shows a representation of three lighting device assemblies 400, 401 and 402 mounted in a ceiling 404, and producing combined light pattern on a vertical wall surface 406*a*. Each lighting device assembly 400, 401 and 402 may correspond to any of the lighting device assemblies 100 with a mounting housing 112, 112' (or other suitable mounting structure) and a further optic 180 or 180'. In FIG. 18, a light pattern 408 is produced when the primary optic 104 in the lighting device assembly 100 has a first configuration (e.g., a 50 degree optic). In FIG. 19, a different light pattern 409 is produced by the same set of lighting device assemblies 400, 401 and 402, when the primary optic 104 is (or has been switched out and replaced with) a second optic of a second configuration (e.g., a 10 degree optic). In other examples, the primary optic 104 may have any suitable optical characteristic or angle degree (including, but not limited to, degrees in the range of 5 degrees to 90 degrees).

In some examples, a lighting device assembly system or kit may include a lighting device assembly 100, one or more mounting housings 112, 112' (e.g., a plurality of mounting housings of different shapes or designs), one or more primary optics 104 (e.g., a plurality of primary optics having different optical characteristics or angle degrees), one or more further optic members 180, 180' (e.g., a plurality of further optic members having optics of different optical characteristics relative to each other). In those examples, an appropriate mounting housing, an appropriate primary optic, and/or an appropriate further optic may be selected from the system or kit, to employ with the lighting device assembly 100 and fit a desired installation project. Accordingly, a manufacturer or a user may select one of the mounting housings, one of the primary optics and/or one of the further optic members from the plurality of available mounting housings, primary optics and/or optic members for assembling and installing with a given lighting device assembly 100 for example, to correspond to a customer order or to provide a desired lighting effect at an installation site.

The annular body of the support member 184, 184' has a central opening in which the optic 182 or 182' is received and retained. The optic 182, 182' may be attached to and retained by the annular body of the support member 184 or 184' by any suitable attachment mechanism including but not limited to snap connections, friction fitting, adhesives, clips or other fasteners or combinations thereof. In the example in FIGS. 12-17 and 20, the optic 182, 182' is shaped and configured to be received and retained in the annular body of the support member 184 or 184' by a snap connection between one or more edges or lips on the optic 182, 182' and one or more edges or grooves on the annular body of the support member 184 or 184'.

The optic 182, 182' may be made of any suitably transparent or partially transparent material such as, but not limited to, plastic, glass, ceramic, or combinations thereof. In the example in FIGS. 12, 13 and 20, the optic 182, 182' includes at least one lip or edge (or an annular lip or edge) that engages a corresponding one or more lips or edges (or an annular lip or edge of the body of the support member 184 or 184' (as represented by the top edge of the body of the support member 184 or 184' in the orientation of 12, 13 and 20). In certain examples, a lip or edge 184*c*, 184*c'* of the body of the support member 184, 184' extends continuously around the body of the support member 184, 184'. In other examples, two or more lips or edges are provided at spaced locations around the body of the support member 184, 184'.

The optic 182, 182' may be configured to provide any desired characteristic to the light emitted from the first optic member 104. In the example in FIGS. 12-20, the optic 182, 182' is configured to be a wall wash optic that provides a pattern of light that is directed toward (washes) a vertical wall, when the lighting device assembly is mounted in a ceiling location within a certain vicinity of the wall. In particular examples, the wall wash optic 182, 182' is configured to receive light from the first optic member 104 in a first direction (i.e., a direction of the axis A of the heat sink member 102) and to emit at least a first portion of the received light in a cone or pattern directed vertically downward (or angled downward at a non-zero degree angle relative to the axis A, as represented by $L_1$ in FIG. 20). A second portion of the received light may be emitted in a cone or pattern directed in a second direction different from the first direction (as represented by $L_2$ in FIG. 20). In some examples, the wall wash optic 182, 182' may be configured to direct a sufficient portion of the emitted light in a lateral direction onto a vertical surface of a wall (or other object) to provide greater light intensity at about eye level of a typical adult human than at other levels on the wall. In other examples, the wall wash optic 182, 182' may be configured to direct a sufficient portion of the emitted light in a lateral direction to provide a relatively even distribution of light onto a vertical surface. In those or other examples, the wall wash optic 182, 182' may be configured to direct a sufficient portion of the emitted light in a lateral direction and in the downward direction, to provide a distribution of light on a floor directly below the lighting device assembly 100 and on a wall (or other object) laterally adjacent the lighting device assembly 100. In certain examples, a lighting device assembly 100 may include (or operate with) a plurality of different further optics 182, 182' (such as, but not limited to a plurality of different wall wash optics having respectively different light emission patterns or effects), where a user may select any desired one of the further optics 182, 182' from the plurality, for installation in the trim member insert 111. Accordingly, a user may select and install a further optic that provides a desired lighting pattern or effect.

With reference to FIG. 20, an example of the further optic 182 includes a generally rigid structure having a primary optical region 182*a*, an angle inducer or kicker 182*b*, a first lip portion 182*c*, and a support section 182*d*. The optic 182' may have a corresponding configuration. The first lip portion 182*c* may include an annular lip or two or more lip portion sections extending from an outer peripheral edge of the primary optical region 182*a*, and arranged annularly around the axis A in FIGS. 12, 13 and 20. The lip portion 182*c* has a size and shape to fit into the body of the trim member insert 111 or 111' from one side (the larger diameter side as shown on the bottom of FIGS. 12, 13 and 20), and snap over an edge (the edge of the narrower end or upper edge in FIGS. 12, 13 and 20) of the body of the trim member insert 111 or 111', The support section 182*d* extends from another location of the outer edge of the primary optical region 182*a*, and includes a second lip portion 182*e* also having a size and shape fit into the body of the trim member insert 111 or 111' from one side (the larger diameter side as shown on the bottom of FIGS. 12, 14 and 20), and snap over the same edge (the edge of the narrower end or upper edge in FIGS. 12, 14 and 20) of the body of the trim member insert 111 or 111'. Accordingly, when the optic 182, 182' is inserted through the open, wider end of the body of the trim member insert 111, 111', the first and second lip portions 182*c* and 182*e* are configured to snap over the edge of the narrow end of the body of the trim member insert 111, 111' to secure the optic 182, 182' to the trim member insert 111, 111'. In particular examples, one or each of the first and second lip portions 182*c* and 182*e* is configured to at least partially angle or curve over the edge of the narrower end of the body of the trim member insert 111, 111', to help retain the optic 182 or 182' within the body of the trim member insert 111, 111'.

When the trim member insert 111, 111' is installed in the trim member 110, 110' and the mounting housing 112 or 112', the primary optical region 182*a* of the further optic 182, 182' is arranged in alignment with the first optic member 104, to receive a portion of the light emitted (in a first direction or along the axis A) from the first optic member 104, and redirect the light as represented in FIG. 20.

In the example in FIGS. 12-17 and 20, the primary optical region 182*a* and the angle inducer 182*b* have a first surface (a light receiving surface) facing the first optic member, and the optic member 182 is supported by the support member 184 in an orientation with the plane of the first surface at an orthogonal angle relative to the axis A. The primary optical region 182*a* has a second surface (a light emitting surface) that is also at an orthogonal angle relative to the axis A.

In the example in FIGS. 12-17 and 20, the angle inducer or kicker 182*b* has a generally wedge or prism shape (having a triangular cross-section shape) where the wider end of the wedge or triangle cross-section shape is closer to the first optic member 104 than the narrower end of the wedge or triangle cross-section shape. In the example in FIG. 20, the support section 182*d* has an L-shaped cross section with a first leg of the L shape extending from the angle inducer or kicker 182*b* and a second leg of the L shape extending along (e.g., abutting and in pressing contact with) the interior surface 184*a* of the body of the support member 184.

The angle inducer or kicker 182*b* is located on one side and laterally spaced from the axis A. In some examples, the angle inducer or kicker 182*b* may curve partially around the axis A. The angle inducer or kicker 182*b* is supported in an orientation in which the narrower end of the wedge or triangle cross-section is directed generally outward toward the larger diameter end of the support member 184.

Figure 21:
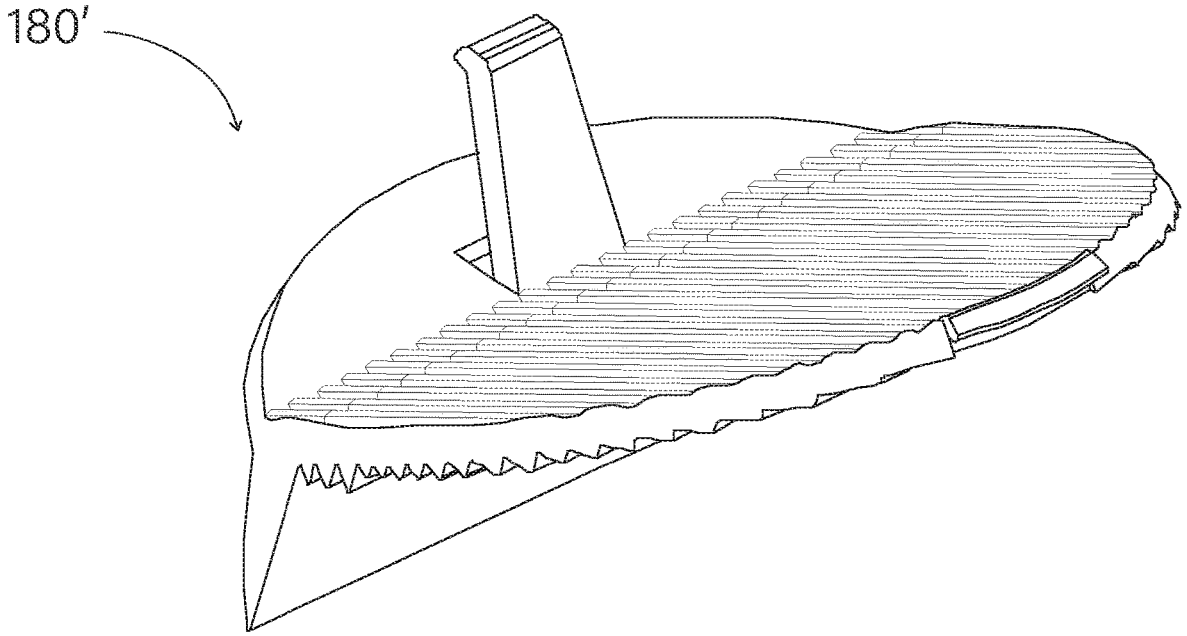
FIG. 21 is a top perspective view of a further optic.
Figure 22:
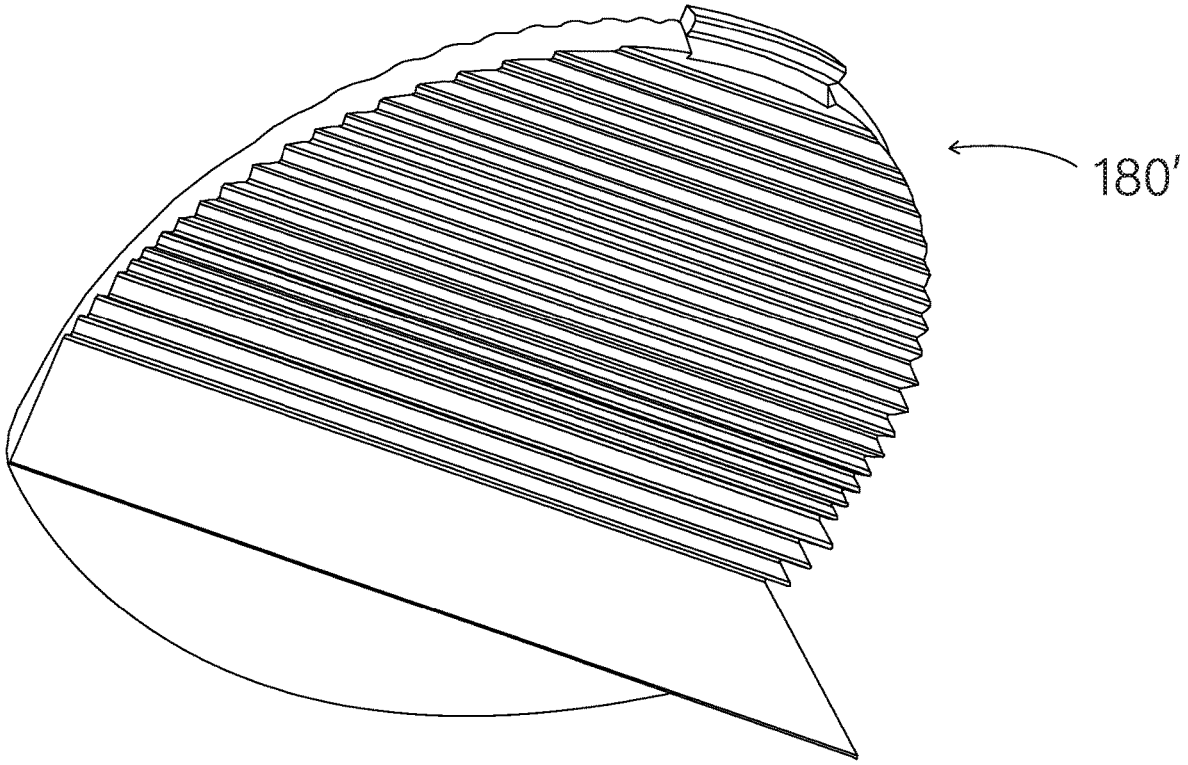
FIG. 22 is a bottom perspective view of the further optic of FIG. 21.

In certain examples, the first surface of the primary optical region 182*a* (as shown in the top perspective view of the further optic 182' in FIG. 21) may have a first pattern of ridges or grooves that affect the characteristics of the light pattern emitted by the optic member. Alternatively or in addition, the second surface the primary optical region 182*a* (as shown in the bottom perspective view of the further optic 182' in FIG. 22) may have a second pattern of ridges or grooves that affect the characteristics of the light pattern emitted by the optic member. In some examples, the second pattern of ridges and grooves is different from the first pattern of ridges and grooves. For example, in FIG. 21, the first pattern of ridges and grooves include a plurality of parallel ridges and grooves that have lengthwise dimensions in a first direction (e.g., a direction perpendicular to or transverse to the lengthwise dimension of the angle inducer or kicker 182*b*). However, in FIG. 22, the second pattern of ridges and grooves include a plurality of parallel ridges and grooves that have lengthwise dimensions in a second direction (e.g., a direction generally parallel to or corresponding to the lengthwise dimension of the angle inducer or kicker 182*b*). While the drawings in FIGS. 21 and 22 show the first and second patterns of ridges and grooves on the further optic 182', similar first and second patterns of ridges and grooves may be provided on the further optic 182 of FIGS. 12 and 14.

In certain examples, the first pattern of ridges and grooves is configured to direct and spread light in a first direction or range (for example, to spread light horizontally across a vertical wall surface from a lighting device assembly 100 mounted in or on a ceiling). In those or other examples, the second pattern of ridges and grooves is configured to direct and spread light in a second direction or range (for example, to spread light vertically up and down the same vertical wall surface from the lighting device assembly 100 mounted in or on a ceiling). In other examples, the locations of the first and second patterns of ridges and grooves may be reversed, such that the first pattern is provided on the second surface of the primary optical region 182*a*, while the second pattern is provided on the first surface of the primary optical region 182*a*. In yet other examples, other suitable patterns of ridges and grooves or of other features affecting light characteristics may be employed on the first and second surfaces of the primary optical region 182*a*.

In certain examples, the further optic member 180, 180' is configured to re-direct light emitted from the primary optic member 104 onto a wall or other object, for example, where the lighting device assembly 100 is mounted in or on a ceiling, for example, as shown in FIGS. 18 and 19. In other examples, the further optic member 180, 180' may be configured to re-direct light onto a ceiling surface, where the lighting device assembly 100 is mounted in or on a wall (such as, but not limited to a sconce mounting configuration) . In those or other examples, the primary optical region 182*a* of the further optic member 180, 180' may include a diffuser lens that diffuses light received from the primary optic member 104. In such examples, the diffuser lens may blend light rays, light beam artifacts and discolorations that may be produced by the light source 108. In other examples, further optic member 180, 180' may comprise other optical devices such as, but not limited to, other types of lenses, color filters, other types of filters, transparent covers for inhibiting passage of moisture or dust, combinations thereof, or the like.

Twist Lock System

As discussed above, the base plate 113 is supported for rotation about the base plate axis $A_p$. In particular examples, the light engine assembly may be assembled as a unit, including the base plate 113, the heat sink member 102, the light source 108, and the frame member 109, and, in some examples, the optic member 104, and the optic holder 106, as well. The light engine assembly may be configured to be installed, together as a unit, through the open side (e.g., the open bottom side in FIGS. 1-5 and 7-9), to a position partially through the circular opening of the top wall of the mounting housing, as shown in FIG. 1, to connect the base plate to the rotary support structure 150 on the mounting housing 112, 112'.

In certain examples, the rotary support structure 150 is secured to (or formed on or as part of) the mounting housing 112, 112'. The base plate 113 may connect to the rotary support structure 150 via any suitable connection mechanism including, but not limited to a clip or snap connection, a bayonet locking connection or other twist-locking mechanism.

As described above, in certain examples, the rotary support structure 150 includes at least one annular ring member (e.g., first and second annular ring members 152 and 154 shown in FIG. 3) supported on the support structure 112, 112' for rotary motion about the axis $A_p$. An example of a rotary support structure 150 having first and second annular ring members 152 and 154 is described in further detail with reference to FIGS. 23-26, which show a mounting housing 112' having a cylindrical configuration. However, the description of the rotary support structure 150 is similarly applicable to a lighting device apparatus 100 having a rectangular, cuboid-shaped mounting housing 112, or other suitable-shaped mounting housing.

Figure 23:
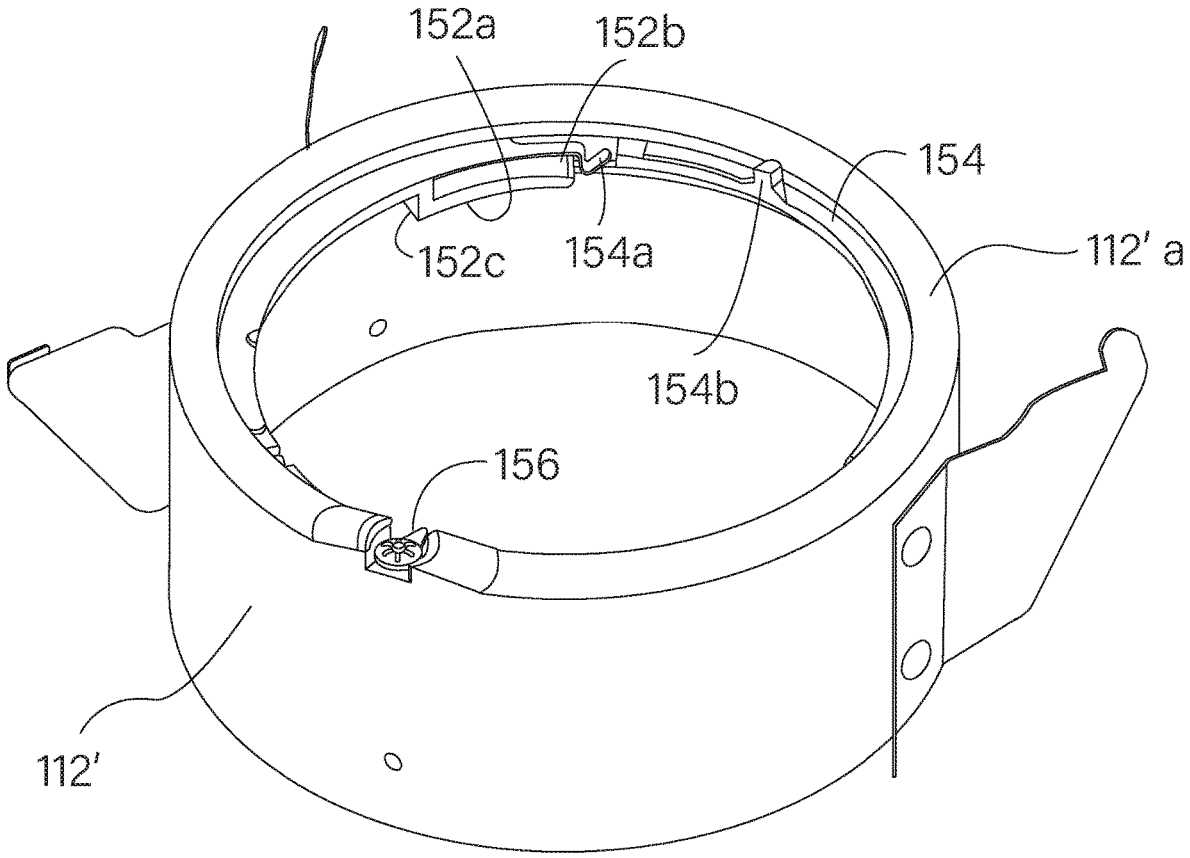
FIG. 23 is a top perspective view of a mounting housing and a rotary support structure.
Figure 24:
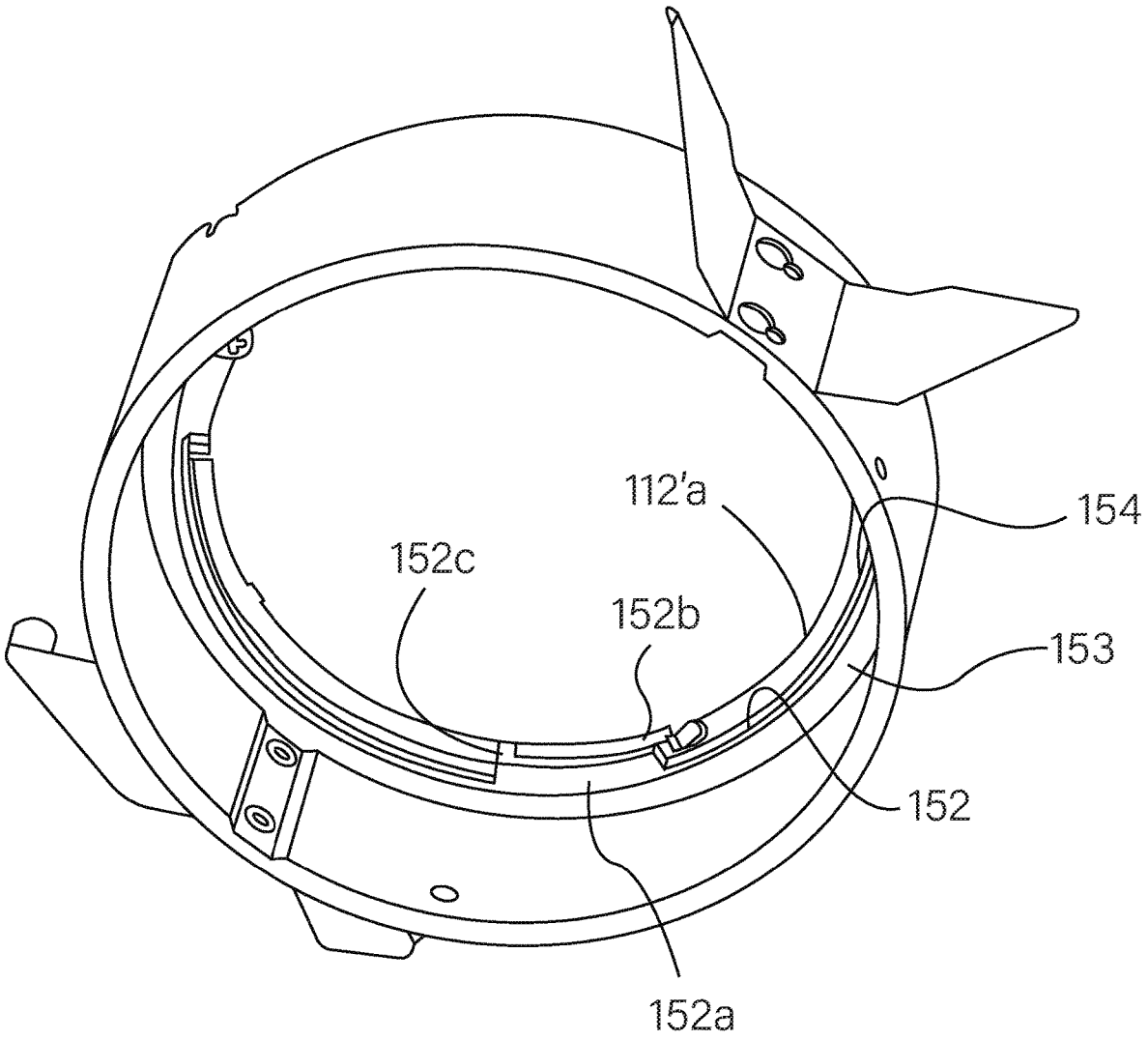
FIG. 24 is a bottom perspective view of the mounting housing and the rotary support structure of FIG. 23.

As shown in FIGS. 23 and 24, the mounting housing 112' has a round opening on one end (the top end in FIGS. 23 and 24) and an annular lip 112*a'* around the opening. The annular lip 112*a'* extends radially inward around the opening. FIGS. 23 and 24 show two different perspective views of the mounting housing 112', with the first and second annular ring members 152 and 154 on an inner surface of the mounting housing 112'. The ring members 152 and 154 are arranged along a round inner surface of the mounting housing 112', adjacent the opening in the mounting housing.

The annular ring members 152, 154 are rotatably secured to the support structure 112, 112' in any suitable manner. In certain examples as described above, the annular ring members 152, 154 are held by the further ring member 153. In particular examples, the further ring member 153 is a spring ring clasp that tightly secures to the support structure 112', and holds the annular ring members 152, 154 in an annular channel between the further ring member 153 and the annular lip 112'*a* for rotation about the axis $A_p$, as described above. In other examples, the annular ring members 152, 154 may be secured to the support structure 112' for rotation about the axis $A_p$ by other suitable rotatory support structure, including but not limited to an annular groove formed in the round inner surface of the support structure 112' adjacent the round opening.

Figure 25:
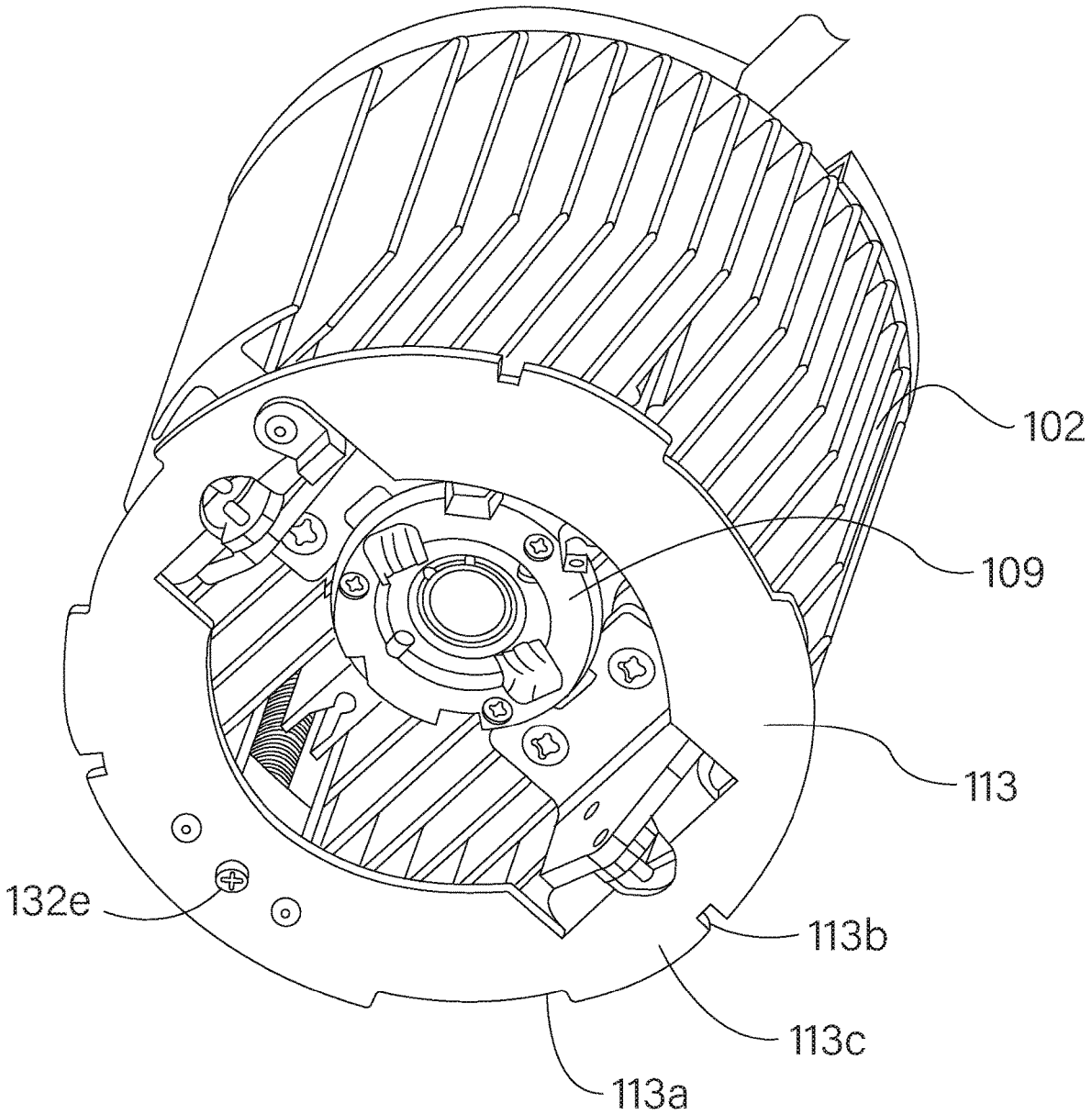
FIG. 25 is a bottom perspective view of a light engine assembly including a base plate.

As discussed above, the base plate 113 is configured to be selectively connected to the annular ring members 152, 154 for rotation with the annular ring member(s) 152, 154 around the axis $A_p$ relative to the mounting housing 112'. In certain examples, the base plate 113 connects with the ring members 152, 154 by a releasable connection mechanism, that allows the light engine assembly to be selectively connected and selectively disconnected (as a unit) to or from the annular ring members 152, 154 (and, thus, to or from the mounting housing 112'). An example of a light engine assembly (unit) is shown in FIG. 25. In other examples, the light engine assembly (unit) also includes the optic holder 106 and the optic member 104, connected to the frame member 109.

The light engine assembly may be passed partially through the support structure 112' (from the open bottom end of the support structure 112' and partially through the opening on the top end of the support structure 112' in the orientation shown in FIGS. 23 and 24), until the base plate 113 aligns with and abuts the annular ring member 152. In particular examples, the base plate 113 has an outer diameter that is smaller than the inner diameter of the spring ring member 153, but smaller than the inner diameter of at least one or more portions of the ring member 152. Accordingly, as the light engine assembly is passed partially through the support structure 112', the base plate 113 will, eventually, contact and abut the ring member 152 (the bottom-facing surface of the ring member 152 in FIG. 24).

In particular examples, a peripheral edge portion of the base plate 113 has one or more connection features that align with one or more corresponding connection features on one or both of the annular ring members 152, 154, when the light engine assembly is passed partially through the support structure 112'. When the connection features are aligned, the light engine assembly (unit) may be rotated in one direction (or in either direction) about the axis $A_p$ a particular amount, to lock the base plate 113 (and the light engine assembly) to the annular ring members 152, 154. Once locked, the base plate 113 (and the light engine assembly) may be rotated with the annular ring members 152, 154 about the axis $A_p$, at least between first and second rotary positions defined by one or more stop members 156. In particular examples, the first and second rotary positions (defined by the stop member(s) 156) may allow the base plate 113 (and the light engine assembly) to rotate almost 360 degrees, to provide a broad range of rotatably adjustable positions of the light engine assembly about the axis $A_p$. In other examples, one or more stop members 156 may be arranged to define a more limited range of rotational motion between first and second rotary positions.

The base plate 113 may be unlocked from a locked state, for example, by manually engaging and rotating the base plate 113 (or the light engine assembly unit) with the annular ring members 152, 154 in a first direction, until reaching a first or a second rotary position (defined by the stop member (s) 156), and then applying additional manual force to continue to rotate the base plate 113 (or the light engine assembly unit) in the first direction beyond the first or second rotary positions (defined by the stop member 156). When the additional force is applied, the stop member 156 holds the annular ring members 152, 154 from further rotation beyond the first or second rotary position additional force, but the base plate 113 may rotate and release its connection features from the corresponding connection features on the annular ring members 152 and 154. The stop member(s) 156 and the additional force required to continue to rotate the base plate 113 can provide a tactile detectable indication (feel) to the user, that the base plate 113 (and the light engine assembly unit) has been released from a locked state.

Once released from the locked state, the user may manually remove the light engine assembly unit from the support structure 112', by gripping the light engine assembly and pulling it through and out of the support structure 112'. In some examples, the light engine assembly unit may be removed from the support structure 112', while the support structure 112' is in (or remains in) an installed state in a ceiling, wall or other structure. In particular examples, the light engine assembly unit may be selectively removed from an installed state, for inspection, servicing, replacement, or the like. After removal of the light engine assembly unit from the support structure 112', a length of the electrical conductors 114 may be pulled through the support structure 112' and, if desired, by be disconnected from the light engine assembly unit. Thereafter, the same or a different light engine assembly unit may be electrically connected and installed back into the support structure 112'.

In the example in FIGS. 23-26, the connection features on the base plate 113 includes one or more sets of recesses or notches on the peripheral edge of the base plate 113, where each set includes a first recess or notch 113*a* and a second recess or notch 113*b*. The first recess or notch 113*a* is wider than the second recess or notch 113*b* in the set. In the example in FIG. 25, the base plate 113 has three sets of recess or notches, to allow the base plate 113 to align with the annular ring member 152 in any one of three possible rotational orientations and/or provide three connection points around the circumference of the base plate 113. Other examples may have one set or any other suitable number of sets of recesses or notches, for any suitable number of possible rotational orientations of alignment and/or points of connection.

In the example in FIGS. 23-26, the connection features on the annular ring members 152, 154 includes one or more shelf-like projection 152*a* that extend axially (downward in FIG. 24) into the interior of the support structure 112' relative to the rest of the annular ring member 152. Each shelf-like projection 152*a* is open on one side (the upward side in FIG. 24). Each shelf-like projection 152*a* extends along a portion of the circumferential length of the annular ring member 152*a* and is open on one end 152*b* and closed on its opposite end 152*c*. Each shelf-like projection 152*a* provides a receiving shelf (the upper-facing surface of the projection 152*a* in FIG. 23) that receives a peripheral edge portion of the base plate 113, when the base plate 113 is in (and being moved into) a locked state with the annular ring member 152.

The connection features on the annular ring members 152, 154 also includes at least one spring member 154*a* that are provided on the annular ring member 154. In certain examples, each spring member 154*a* is cut from and unitary with the rest of the annular ring member 154 and bent into shape. In particular examples, each spring member 154*a* is bent to form a U or V-shaped projection extending axially (downward in FIG. 24) into the support structure 112'. When the annular ring members 152 and 154 are connected to the support structure 112', the spring member 154*a* projects (downward in FIG. 24) into the open side (the upward side in FIG. 24) of the shelf-like projection 152*a*, as shown in FIGS. 23 and 24.

Figure 26:
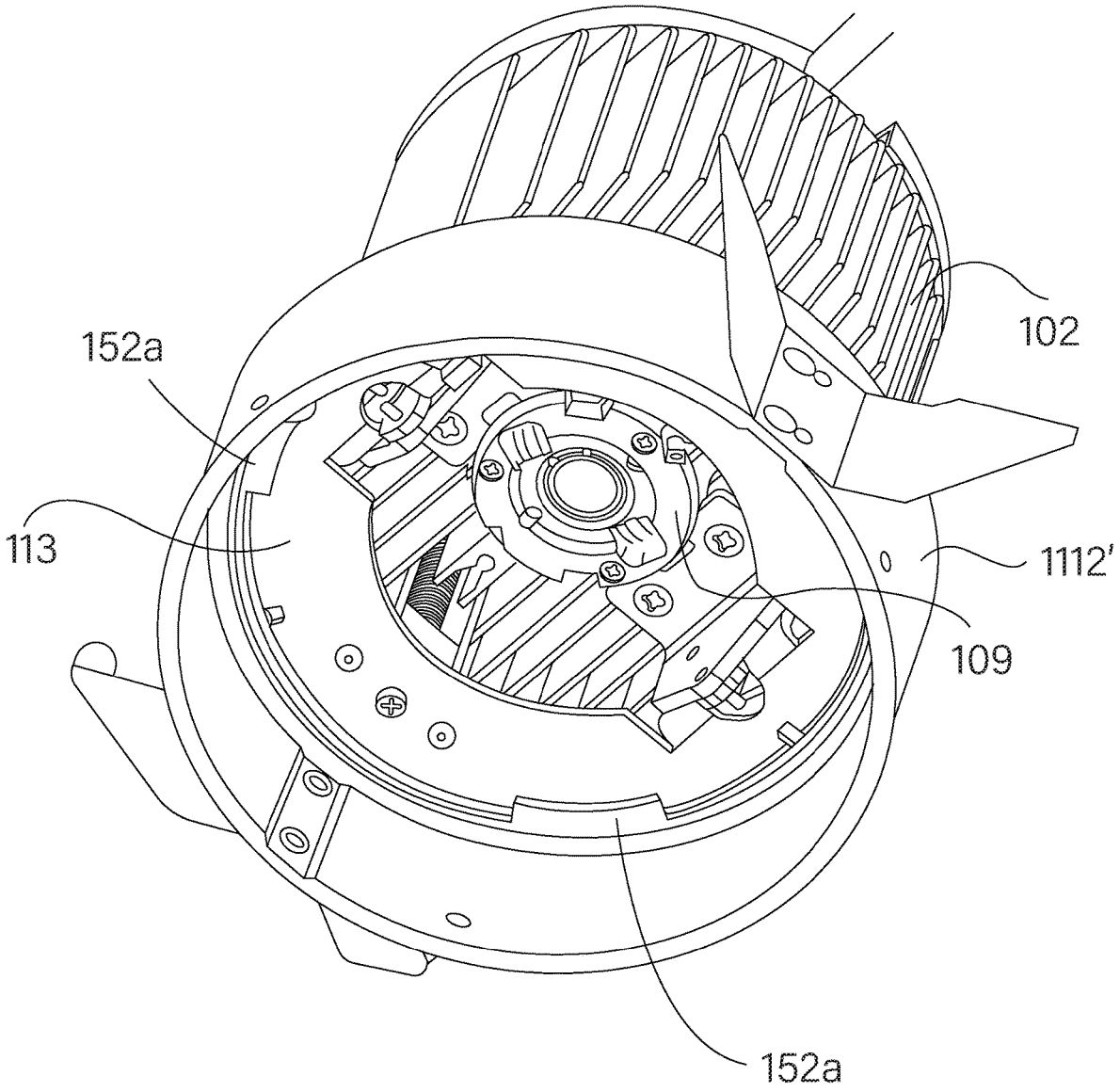
FIG. 26 is a bottom perspective view of the light engine assembly of FIG. 25 being connected with the mounting housing of FIGS. 23 and 24.

To connect the base plate 113 (and the light engine assembly unit) to the support structure 112', the heat sink member 102 of the light engine assembly unit is passed axially through the open bottom end of the support structure 112', and axially then through the opening in the top end of the support structure 112' until the base plate 113 of the light engine assembly unit engages with the downward-facing surface of the annular ring member 152. In addition, the base plate 113 (and the light engine assembly unit) is rotated relative to the support structure 112' until the one or more wider recess or notch 113*a* on the base plate 113 aligns with the one or more shelf-like projections 152*a* on the annular ring member 152, as shown in FIG. 26.

In that aligned position, the base plate 113 (and the light engine assembly unit) may be manually pushed axially upward against the spring force of the one or more spring members 154*a*, to push the one or more spring members 154*a* axially upward. In that state, the base plate 113 (and the light engine assembly unit) may be manually rotated about the axis $A_p$ in a first direction (e.g., clockwise in FIG. 26).

Initially, the annular ring members 152 and 154 may rotate with the base plate 113. However, as the annular ring members 152 and 154 rotate, a projection feature 154*b* on the annular ring member 154 moves in a rotary path to a position at which the projection feature 154*b* engages with the stop member 156 and is inhibited from further rotation. At that state, the annular ring members 152 and 154 are stopped from further, while further manual rotation force on the base plate 113 (and the light engine assembly unit) continues to rotate the base plate 113 relative to the annular ring members 152 and 154 and the support structure 112' in the first direction.

Such continued rotation of the base plate 113 relative to the annular ring members 152 and 154 causes one or more portions of the peripheral edge of the base plate 113 (e.g., the edge portions 113*c* located between the recesses or notches 113*a* and 113*b* in each set), each to be moved through the open end 152*b* and over one of the shelf-like projection 152*a*. As the one or more peripheral edge portions 113*c* move onto and over the one or more shelf-like projections 152*a*, the base plate 113 may continue to rotate until the edge portion(s) 113*c* contact the closed end 152*c* of the shelf-like projection(s) 152*a*. At that position, the base plate 113 abuts against the closed end 152*c* of the shelf-like projection(s) 152*a* and cannot be further rotated in the first direction relative to the annular ring member 152. In addition, at that position, the one or more spring members 154*a* align with the one or more second recesses or notches 113*b* in the base plate 113 and, due to the natural spring force of the spring member(s) 154*a*, snap (downward) to protrude into the second recess(es) or notch(es) 113*b* in the base plate 113, to lock the base plate 113.

More specifically, when the one or more spring member (s) 154*a* protrude into the second recess(es) or notch(es) 113*b* in the base plate 113, the base plate 113 (and the light engine assembly unit) is locked onto the annular ring members 152, 154. In that state, the base plate 113 (and the light engine assembly unit) may be rotated about the axis $A_p$ in a second direction (e.g., counter-clockwise). from the position in which the projection feature 154*b* engages the stop member 156, and back again, to adjust the rotary position of the base plate 113 (and the light engine assembly unit) relative to the support structure 112'.

From the state in which the base plate 113 (and the light engine assembly unit) is locked to the annular ring members 152, 154, the base plate 113 may be selectively unlocked. More specifically, by rotating the base plate 113 (and the light engine assembly unit) about the axis $A_p$ in the second direction (e.g., counter-clockwise). to the position in which the projection feature 154*b* engages the stop member 156 from the second direction. At that position, the annular ring members 152 and 154 cannot be further rotated in the second direction. Accordingly, further manual force to rotate the base plate 113 in the second direction causes the base plate 113 to rotate relative to the annular ring members 152 and 154, and causes the edge portion 113*c* of the base plate 113 to move through the open end 152*b* and off of the shelf-like projection 152*a*. As the base plate rotates relative to the annular ring members 152 and 154, the peripheral edge portion(s) 113*c* of the base plate 113 engage and push (upward) the spring member(s) 154*a* against the spring force to move the spring member(s) 154*a* out of the second recess(es) or notch(es) 113*b*, to unlock the base plate 113 (and the light engine assembly unit) from the annular ring members 152, 154. Once unlocked, the light engine assembly unit may be withdrawn from the support structure 112', for inspection, repair or replacement, as discussed herein.

Any of the examples described herein may include a rotary support structure 150 with a twist and lock mechanism that allows for easy connection and disconnection of a light engine assembly unit, as described herein. In other examples, other suitable rotary support structures may be employed, to support the base plate 113 for rotary movement about the axis $A_p$ relative to the support structure 112, 112'.

In certain examples, the lighting device assembly (including assembled lighting components, including the heat sink member 102, light source 108, optic member 104, and optic holder 106) is configured to be installed (with a twist and lock mechanism as described herein or other connection mechanism), in any one of multiple different mounting housings 112, 112' for example, of different types or styles. Accordingly, the same lighting device assembly configuration may be manufactured for multiple different types or styles of lighting device systems, for improved manufacturing efficiency.

In various examples described herein, certain components are described as having a round shape, cup shape, square shape, rectangular shape, or cylindrical shaped portions, including, but not limited to the heat sink member 102, the trim member 110, the end cap 116, the mounting housing 112 or 112', the further housings 200, 300, and the further optic device 180, 180'. However, in other examples, those components may have other suitable shapes including, but not limited to shapes having polygonal or other circular or non-circular cross-sections (taken perpendicular to the axis A) or combinations thereof. In some examples, those components may have an outer shape configured to provide an aesthetically pleasing, artistic, industrial or other impression.

The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. A lighting device assembly comprising:

a heat sink member;

a light source attached to the heat sink member in a position to emit light in a first direction;

a support structure for supporting the heat sink member in a pivotally adjustable orientation about the first adjustment axis, to allow adjustment of the first direction;

a drive mechanism for selectively driving the heat sink member to pivotally adjust the orientation of the heat sink member about the first adjustment axis to change the first direction, the drive mechanism including:

a threaded drive screw having a lengthwise drive screw axis and supported for rotation about the drive screw axis, with the drive screw axis being fixed relative to the first adjustment axis;

a collar threaded to the drive screw to move linearly along the drive screw axis as the drive screw is rotated about the drive screw axis relative to the collar;

at least one strut pivotally coupled to the collar and further pivotally coupled to the heat sink member, to transfer linear movement of the collar along the drive screw axis to pivotal movement of the heat sink member about the first adjustment axis, to change the angle of the first direction;

wherein the support structure includes a support plate supported in a rotatably adjustable orientation about a second adjustment axis transverse to the first adjustment axis;

wherein at least one flange extends from a first end portion of the heat sink member and is connected to a pivot joint for pivotal movement of the heat sink member about the first adjustment axis; and wherein at least one further flange extends from the support plate and is arranged in thermal contact with the at least one flange extending from the first end portion of the heat sink member to transfer heat between the contacting flanges.

2. The assembly of claim 1, further comprising a first pivotal joint having a first joint axis connecting the at least one strut to the collar, and a second pivotal joint having a second pivotal axis connecting the at least one strut to the heat sink member, the first joint axis being parallel to the second joint axis.

3. The assembly of claim 2, wherein the first joint axis and the second joint axis are parallel to the first adjustment axis.

4. A lighting device assembly comprising:

a heat sink member;

a light source attached to the heat sink member in a position to emit light in a first direction;

a support structure for supporting the heat sink member in a pivotally adjustable orientation about the first adjustment axis, to allow adjustment of the first direction;

a drive mechanism for selectively driving the heat sink member to pivotally adjust the orientation of the heat sink member about the first adjustment axis to change the first direction, the drive mechanism including:

a threaded drive screw having a lengthwise drive screw axis and supported for rotation about the drive screw axis, with the drive screw axis being fixed relative to the first adjustment axis;

a collar threaded to the drive screw to move linearly along the drive screw axis as the drive screw is rotated about the drive screw axis relative to the collar;

at least one strut pivotally coupled to the collar and further pivotally coupled to the heat sink member, to transfer linear movement of the collar along the drive screw axis to pivotal movement of the heat sink member about the first adjustment axis, to change the angle of the first direction;

wherein the support structure includes a support plate supported in a rotatably adjustable orientation about a second adjustment axis, to allow adjustment of the first direction about the second adjustment axis that is transverse to the first adjustment axis; and wherein either:

the second adjustment axis is perpendicular to the first adjustment axis;

the support structure further includes a mounting housing configured to be secured in or to a ceiling, wall or other object, and a guide rail provided on the mounting housing, the guide rail supporting the support plate for rotational movement about the second adjustment axis; or the support structure further includes a rotary mount on the support plate for supporting the drive screw for rotation about the lengthwise drive screw axis relative to the rotary mount, and to retain the drive screw from movement in a linear direction of the drive screw axis relative to the rotary mount as the drive screw is rotated about the drive screw axis relative to the rotary mount.

5. The assembly of claim 4, wherein the support structure further includes a rotary mount on the support plate for supporting the drive screw for rotation about the lengthwise drive screw axis relative to the rotary mount, and to retain the drive screw from movement in a linear direction of the drive screw axis relative to the rotary mount as the drive screw is rotated about the drive screw axis relative to the rotary mount, and wherein the drive screw includes a first section having threads, a second section devoid of threads and a shoulder located between the first section and the second section, the second section is located within a channel in the rotary mount, and the first section and the shoulder are located outside of the rotary mount.

6. A lighting device assembly comprising:

a heat sink member;

a light source attached to the heat sink member in a position to emit light in a first direction;

a support structure for supporting the heat sink member in a pivotally adjustable orientation about the first adjustment axis, to allow adjustment of the first direction;

a drive mechanism for selectively driving the heat sink member to pivotally adjust the orientation of the heat sink member about the first adjustment axis to change the first direction, the drive mechanism including:

a threaded drive screw having a lengthwise drive screw axis and supported for rotation about the drive screw axis, with the drive screw axis being fixed relative to the first adjustment axis;

a collar threaded to the drive screw to move linearly along the drive screw axis as the drive screw is rotated about the drive screw axis relative to the collar;

at least one strut pivotally coupled to the collar and further pivotally coupled to the heat sink member, to transfer linear movement of the collar along the drive screw axis to pivotal movement of the heat sink member about the first adjustment axis, to change the angle of the first direction;

wherein the support structure includes a support plate supported in a rotatably adjustable orientation about a second adjustment axis, to allow adjustment of the first direction about the second adjustment axis that is transverse to the first adjustment axis; and wherein the assembly further including a mounting housing configured to be secured in or to a ceiling, wall or other object, the support plate is supported on the mounting housing for rotation about the second adjustment axis relative to the mounting housing; housing, the mounting housing has an open side that is exposed when the mounting housing is secured in a ceiling, wall or other object, and an end portion of the drive screw extends through the support plate and is accessible through the open side of the mounting housing, to allow rotation of the drive screw.

7. The assembly of claim 1, wherein the support structure includes at least one flange extending from a first end portion of the heat sink member and connected to a pivot joint for pivotal movement of the heat sink member about the first adjustment axis.

8. A lighting device assembly comprising:

a heat sink member;

a light source attached to the heat sink member in a position to emit light in a first direction;

a support structure for supporting the heat sink member in a pivotally adjustable orientation about the first adjustment axis, to allow adjustment of the first direction, the support structure including at least one flange extending from a first end portion of the heat sink member and connected to a pivot joint for pivotal movement of the heat sink member about the first adjustment axis;

a drive mechanism for selectively driving the heat sink member to pivotally adjust the orientation of the heat sink member about the first adjustment axis to change the first direction, the drive mechanism including:

a threaded drive screw having a lengthwise drive screw axis and supported for rotation about the drive screw axis, with the drive screw axis being fixed relative to the first adjustment axis;

a collar threaded to the drive screw to move linearly along the drive screw axis as the drive screw is rotated about the drive screw axis relative to the collar; and at least one strut pivotally coupled to the collar and further pivotally coupled to the heat sink member, to transfer linear movement of the collar along the drive screw axis to pivotal movement of the heat sink member about the first adjustment axis, to change the angle of the first direction; and a mounting housing configured to be secured in or to a ceiling, wall or other object, wherein:

the support structure is secured to the mounting housing;

the mounting housing has an open side that is exposed when the mounting housing is secured in a ceiling, wall or other object;

a tilt indicator is provided on the mounting housing in a location that is viewable through the exposed open side of the mounting housing; and the tilt indicator has a surface that is overlapped by a portion of the at least one flange, where an amount of overlap of the surface by the at least one flange is dependent upon and changes with the pivotal movement of the heat sink member about the first adjustment axis.

9. The assembly of claim 8, wherein:

the support structure includes a support plate supported in a rotatably adjustable orientation about a second adjustment axis transverse to the first adjustment axis;

at least one flange extends from a first end portion of the heat sink member and is connected to a pivot joint for pivotal movement of the heat sink member about the first adjustment axis; and at least one further flange extends from the support plate and is arranged in thermal contact with the at least one flange extending from the first end portion of the heat sink member to transfer heat between the contacting flanges.

10. The assembly of claim 9, wherein one of the at least one flange and the at least one further flange has a projection and the other of the at least one flange and the at least one further flange has a curved slot in which the projection is received and slides during pivotal movement of the heat sink member about the first adjustment axis.

11. The assembly of claim 9, wherein the one of the at least one flange comprises two flanges that extend from the first end portion of the heat sink, and the at least one further flange comprises two flanges that extend from the support plate and that are in thermal contact with the two flanges that extend from the first end portion of the heat sink.

12. A lighting device assembly comprising:

a heat sink member;

a light source attached to the heat sink member in a position to emit light in a first direction;

a support structure for supporting the heat sink member in a pivotally adjustable orientation about the first adjustment axis, to allow adjustment of the first direction, the support structure including at least one flange extending from a first end portion of the heat sink member and connected to a pivot joint for pivotal movement of the heat sink member about the first adjustment axis;

a drive mechanism for selectively driving the heat sink member to pivotally adjust the orientation of the heat sink member about the first adjustment axis to change the first direction, the drive mechanism including:

a threaded drive screw having a lengthwise drive screw axis and supported for rotation about the drive screw axis, with the drive screw axis being fixed relative to the first adjustment axis;

a collar threaded to the drive screw to move linearly along the drive screw axis as the drive screw is rotated about the drive screw axis relative to the collar; and at least one strut pivotally coupled to the collar and further pivotally coupled to the heat sink member, to transfer linear movement of the collar along the drive screw axis to pivotal movement of the heat sink member about the first adjustment axis, to change the angle of the first direction;

wherein the heat sink member has at least one slot in which the at least one strut is at least partially received during some or all of the pivotal movement of the heat sink member about the first adjustment axis.

13. The assembly of claim 12, wherein the at least one strut comprises a first strut on one side of the collar and a second strut on a second side of the collar, and wherein the collar is located between the first strut and the second strut.

14. The assembly of claim 1, wherein the support structure is configured to support the heat sink member for pivotally adjustable movement about the first adjustment axis to adjust an angle of the first direction relative to a reference axis.

15. The assembly of claim 1, wherein the first direction corresponds to an axis of a cone or pattern of light emitted by the light source, when the light source is energized.

16. A system including a plurality of lighting device assemblies each lighting device assembly comprising:

a heat sink member;

a light source attached to the heat sink member in a position to emit light in a first direction, a support structure for supporting the heat sink member in a pivotally adjustable orientation about the first adjustment axis, to allow adjustment of the first direction, the support structure including at least one flange extending from a first end portion of the heat sink member and connected to a pivot joint for pivotal movement of the heat sink member about the first adjustment axis;

a drive mechanism for selectively driving the heat sink member to pivotally adjust the orientation of the heat sink member about the first adjustment axis to change the first direction, the drive mechanism including:

a threaded drive screw having a lengthwise drive screw axis and supported for rotation about the drive screw axis, with the drive screw axis being fixed relative to the first adjustment axis;

a collar threaded to the drive screw to move linearly along the drive screw axis as the drive screw is rotated about the drive screw axis relative to the collar; and at least one strut pivotally coupled to the collar and further pivotally coupled to the heat sink member, to transfer linear movement of the collar along the drive screw axis to pivotal movement of the heat sink member about the first adjustment axis, to change the angle of the first direction;

the system further comprising:

a first mounting housing configured to be secured in or to a ceiling, wall or other object, the first mounting housing configured for being selectively connected to the supporting the support plate of the lighting device assembly;

a second mounting housing configured to be secured in or to a ceiling, wall or other object, the second mounting housing configured for being selectively connected to the supporting the support plate of the lighting device assembly, the second mounting housing having a different shape than the first mounting housing;

wherein the support plate of the lighting device assembly may be selectively coupled to either one of the first mounting housing and the second mounting housing, one at a time, to allow the lighting device assembly to fit into different shaped openings depending upon to which mounting housing of the first and the second mounting housings the support plate is selectively coupled.

17. A method of making a lighting device assembly comprising:

providing a heat sink member;

attaching a light source to the heat sink member in a position to emit light in a first direction;

supporting the heat sink member with a support structure, in a pivotally adjustable orientation about the first adjustment axis, to allow adjustment of the first direction; and coupling a drive mechanism to selectively pivotally adjust the orientation of the heat sink member about the first adjustment axis to change the first direction, including:

supporting a threaded drive screw for rotation about a lengthwise drive screw axis, with the drive screw axis being fixed relative to the first adjustment axis;

threading a collar to the drive screw to allow the collar to move linearly along the drive screw axis as the drive screw is rotated about the drive screw axis relative to the collar; and pivotally coupling at least one strut to the collar and further pivotally coupling the at least one strut to the heat sink member, to transfer linear movement of the collar along the drive screw axis to pivotal movement of the heat sink member about the first adjustment axis, to change the angle of the first direction;

the method further comprising:

supporting the support structure in a rotatably adjustable orientation about a second adjustment axis transverse to the first adjustment axis;

connecting at least one flange extended from a first end portion of the heat sink member to a pivot joint for pivotal movement of the heat sink member about the first adjustment axis; and arranging at least one further flange extended from the support plate in thermal contact with the at least one flange extended from the first end portion of the heat sink member to transfer heat between the contacting flanges.

18. The assembly of claim 12 wherein:

the support structure includes a support plate supported in a rotatably adjustable orientation about a second adjustment axis transverse to the first adjustment axis;

at least one flange extends from a first end portion of the heat sink member and is connected to a pivot joint for pivotal movement of the heat sink member about the first adjustment axis; and at least one further flange extends from the support plate and is arranged in thermal contact with the at least one flange extending from the first end portion of the heat sink member to transfer heat between the contacting flanges.

19. The assembly of claim 18, wherein one of the at least one flange and the at least one further flange has a projection and the other of the at least one flange and the at least one further flange has a curved slot in which the projection is received and slides during pivotal movement of the heat sink member about the first adjustment axis.

20. The assembly of claim 18, wherein the one of the at least one flange comprises two flanges that extend from the first end portion of the heat sink, and the at least one further flange comprises two flanges that extend from the support plate and that are in thermal contact with the two flanges that extend from the first end portion of the heat sink.

* * * * *